US011071993B2

(12) United States Patent
Brandt

(10) Patent No.: US 11,071,993 B2
(45) Date of Patent: Jul. 27, 2021

(54) METHODS AND SYSTEMS FOR FILLING MUFFLERS WITH FIBROUS MATERIAL

(71) Applicant: Owens Corning Intellectual Capital, LLC, Toledo, OH (US)

(72) Inventor: Luc J. L. Brandt, Henri-chapelle (BE)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 56 days.

(21) Appl. No.: 16/568,351

(22) Filed: Sep. 12, 2019

(65) Prior Publication Data

US 2020/0001315 A1 Jan. 2, 2020

Related U.S. Application Data

(63) Continuation of application No. 15/546,031, filed as application No. PCT/US2016/021858 on Mar. 10, 2016, now Pat. No. 10,525,495.

(60) Provisional application No. 62/131,312, filed on Mar. 11, 2015.

(51) Int. Cl.

| | |
|---|---|
| ***B05B 13/06*** | (2006.01) |
| ***F01N 13/18*** | (2010.01) |
| ***B65B 1/10*** | (2006.01) |
| ***B05B 7/14*** | (2006.01) |
| ***F01N 1/24*** | (2006.01) |
| ***B65B 1/02*** | (2006.01) |
| ***B65B 7/28*** | (2006.01) |
| ***B65B 31/00*** | (2006.01) |
| ***B65B 39/00*** | (2006.01) |

(52) U.S. Cl.

CPC ..... *B05B 13/0636* (2013.01); *B05B 7/1409* (2013.01); *B65B 1/02* (2013.01); *B65B 1/10* (2013.01); *B65B 7/2821* (2013.01); *B65B 31/00* (2013.01); *B65B 39/00* (2013.01); *F01N 1/24* (2013.01); *F01N 13/1894* (2013.01); *B05B 13/06* (2013.01); *F01N 2310/02* (2013.01); *F01N 2450/06* (2013.01)

(58) Field of Classification Search

CPC ..... Y10T 29/49398; F01N 2450/06; F01N 2450/04; F01N 2610/142; F01N 13/1984; B05B 13/0636; B65B 1/004; B65B 1/10

See application file for complete search history.

(56) References Cited

U.S. PATENT DOCUMENTS

| | | | |
|---|---|---|---|
| 5,976,453 | A | 11/1999 | Nilsson et al. |
| 6,158,547 | A | 12/2000 | Ackermann et al. |
| 6,412,596 | B1 | 7/2002 | Brandt et al. |

(Continued)

FOREIGN PATENT DOCUMENTS

| | | | |
|---|---|---|---|
| CN | 2088167 | U | 11/1991 |
| CN | 103644013 | A | 3/2014 |

(Continued)

OTHER PUBLICATIONS

Office Action from Brazilian Application No. BR112017018602-0 dated Jun. 30, 2020.

(Continued)

*Primary Examiner* — Christopher J Besler

(74) *Attorney, Agent, or Firm* — Calfee, Halter & Griswold LLP

(57) ABSTRACT

Methods and systems for filling a muffler body with a fibrous material prior to completing assembly of the muffler body are disclosed.

26 Claims, 11 Drawing Sheets

(56) References Cited

U.S. PATENT DOCUMENTS

| | | | |
|---|---|---|---|
| 6,607,052 | B2 | 8/2003 | Brandt et al. |
| 7,077,922 | B2 | 7/2006 | Brandt et al. |
| 7,975,382 | B2 | 7/2011 | Brandt et al. |
| 7,992,301 | B2 | 8/2011 | Lecoester et al. |
| 8,201,660 | B2 | 6/2012 | Han et al. |
| 8,590,155 | B2 | 11/2013 | Nilsson et al. |
| 10,525,495 | B2 * | 1/2020 | Brandt ..... B05B 13/0636 |
| 2002/0129991 | A1 | 9/2002 | Lewin |
| 2005/0001012 | A1 | 1/2005 | Brandt et al. |
| 2005/0067044 | A1 | 3/2005 | Jander |
| 2007/0240934 | A1 | 10/2007 | Van de Flier et al. |
| 2011/0240173 | A1 | 10/2011 | Brandt et al. |

FOREIGN PATENT DOCUMENTS

| | | | |
|---|---|---|---|
| DE | 10105000 | A1 | 8/2002 |
| EP | 0926320 | B1 | 6/1999 |
| WO | 2002038419 | A1 | 5/2002 |
| WO | 02/060763 | A2 | 8/2002 |
| WO | 03/021088 | A1 | 3/2003 |
| WO | 2009079402 | A1 | 6/2009 |

OTHER PUBLICATIONS

Office Action from Indian Application No. 201737027569 dated Jul. 23, 2020.

International Search Report and Written Opinion from PCT/US2016/021858 dated May 23, 2016.

Communication pursuant to Article 94(3) EPC from European Application No. 16713674.6 dated Jun. 20, 2018.

Office Action from Chinese Application No. 2016800144611 dated Mar. 18, 2019.

Office Action from U.S. Appl. No. 15/546,031 dated Apr. 26, 2019.

Notice of Allowance from U.S. Appl. No. 15/546,031 dated Sep. 3, 2019.

Notice of Grounds for Rejection from Korean Application No. 10-2017-7028066 dated Apr. 27, 2021.

* cited by examiner

METHODS AND SYSTEMS FOR FILLING MUFFLERS WITH FIBROUS MATERIAL

RELATED APPLICATIONS

This application is a continuation of U.S. patent application Ser. No. 15/546,031, filed on Jul. 25, 2017, which is the U.S. national stage entry of PCT/US2016/021858, filed on Mar. 10, 2016, which claims priority to and all benefit of U.S. Provisional Application No. 62/131,312, filed on Mar. 11, 2015, the entire disclosures of which are fully incorporated herein by reference.

FIELD

The general inventive concepts relate to methods and systems for filling mufflers with fibrous material.

BACKGROUND

It is known to introduce fibrous material (e.g., glass fibers) into a body of a muffler to absorb and attenuate sound produced by the muffler during operation.

As noted in U.S. Pat. No. 7,975,382, the entire disclosure of which is incorporated herein by reference, many types of exhaust mufflers are produced by mechanically joining multiple pieces to form a muffler shell. For example, one common type of exhaust muffler is known as a spun muffler. Spun mufflers are made by forming a sheet of material into the desired shape to form the muffler body and attaching end caps to this body by welding or crimping to form the muffler shell. Another common type of exhaust muffler is a clamshell muffler, which is assembled by joining an upper section to a lower section by welding or crimping. Both spun mufflers and clamshell mufflers are generally divided into multiple chambers by baffles, or partitions, and contain perforated inlet and outlet pipes that span between the chambers to input and exhaust the gases from the muffler.

A common material used to fill exhaust mufflers is continuous glass fibers. The fibers usually fill one or more of the muffler chambers and are often inserted into the muffler in a texturized, or "bulked up," form. It is known to insert these bulked up fibers into one of the muffler shell components prior to assembling the muffler shell. It is also known to force the bulked up fibers into the assembled muffler shell through either the inlet or outlet pipe. Often, when bulked up fibers are inserted prior to assembling the muffler shell, it is helpful to avoid allowing fibers to stray from the interior muffler cavity and become trapped between the components of the muffler shell. The trapped fibers subsequently have an adverse effect on the quality of the joint between the muffler shell components. It is also helpful to provide generally uniform distribution and filling density of the bulked up fibers when they are forced into the cavities of the assembled muffler shell.

There is a need for improved systems and methods for filling a muffler with a fibrous material prior to completing assembly of the muffler shell.

SUMMARY

The general inventive concepts relate to and contemplate improved methods and systems for filling mufflers with fibrous material.

In an exemplary embodiment, a method of filling a muffler with a fibrous material is provided. The muffler includes a muffler shell having an inlet port and an outlet port. The muffler shell comprises a first shell member and a second shell member. The method comprises: positioning the first shell member relative to the second shell member to form an open portion and a closed portion, the open portion defining a gap sufficient to allow a filling nozzle to fit between the first shell member and the second shell member at the open portion; holding the first shell member and the second shell member together to maintain the open portion and the closed portion; inserting the filling nozzle into the muffler shell through the open portion; introducing the fibrous material into the muffler shell through the filling nozzle; removing the filling nozzle from the muffler shell through the open portion; releasing the first shell member and the second shell member; positioning the first shell member relative to the second shell member to remove the open portion; and affixing the first shell member to the second shell member.

In an exemplary embodiment, holding the first shell member and the second shell member together comprises applying at least one clamp that holds the first shell member and the second shell member together.

In an exemplary embodiment, the method further comprises: evacuating air from within the muffler shell during the introduction of the fibrous material into the muffler shell. In an exemplary embodiment, the air is evacuated from within the muffler shell through at least one of the inlet port and the outlet port.

In an exemplary embodiment, the filling nozzle includes an outlet opening that is shaped to direct the fibrous material along a filling axis, wherein the filling axis differs from (i.e., is not parallel to) a central axis of the filling nozzle. In an exemplary embodiment, the filling axis forms an angle relative to the central axis of the filling nozzle within the range of 0 degrees to 90 degrees. In an exemplary embodiment, the filling axis forms an angle relative to the central axis of the filling nozzle within the range of 10 degrees to 55 degrees.

In an exemplary embodiment, the method further comprises: positioning the outlet opening at a desired filling location within the muffler shell prior to introducing the fibrous material into the muffler shell.

In an exemplary embodiment, the method further comprises: positioning the outlet opening at a first filling location within the muffler shell and introducing a first quantity of the fibrous material into the muffler shell; and positioning the outlet opening at a second filling location within the muffler shell and introducing a second quantity of the fibrous material into the muffler shell. In an exemplary embodiment, the first quantity and the second quantity are the same.

In an exemplary embodiment, the method further comprises: rotating the filling nozzle such that the outlet opening is pointed in a desired filling direction prior to introducing the fibrous material into the muffler shell.

In an exemplary embodiment, the method further comprises: moving the filling nozzle during the introduction of the fibrous material into the muffler shell.

In an exemplary embodiment, the method further comprises: rotating the filling nozzle during the introduction of the fibrous material into the muffler shell.

In an exemplary embodiment, a pipe extends between the inlet port and the outlet port, wherein at least a portion of the pipe within the muffler shell is perforated.

In an exemplary embodiment, the muffler includes a partition forming a first chamber and a second chamber within the muffler shell. In an exemplary embodiment, the inlet port interfaces with the first chamber and the outlet port interfaces with the second chamber. In an exemplary embodiment, at least a portion of the partition is perforated.

In an exemplary embodiment, a first pipe is interfaced with the inlet port and is open to the first chamber, and a second pipe is interfaced with the outlet port and is open to the second chamber. In an exemplary embodiment, at least a portion of the first pipe within the muffler shell is perforated. In an exemplary embodiment, at least a portion of the second pipe within the muffler shell is perforated.

In an exemplary embodiment, the method further comprises: placing a first clamp at a first location of the closed portion; and placing a second clamp at a second location of the closed portion.

In an exemplary embodiment, the method further comprises: inserting a first filling nozzle into the muffler shell at a first location of the open portion; and inserting a second filling nozzle into the muffler shell at a second location of the open portion. In an exemplary embodiment, the muffler includes a partition forming a first chamber and a second chamber within the muffler shell, wherein an outlet opening of the first filling nozzle is positioned within the first chamber and wherein an outlet opening of the second filling nozzle is positioned within the second chamber. In an exemplary embodiment, the fibrous material is introduced into the muffler shell through the first filling nozzle and the second filling nozzle simultaneously.

In an exemplary embodiment, removal of the open portion (i.e., closing of the gap g) occurs at a rate of no more than 10 mm/sec.

In an exemplary embodiment, the gap is within the range of 5 mm to 20 mm.

In an exemplary embodiment, the fibrous material is fiberglass. In an exemplary embodiment, the fiberglass is texturized. In an exemplary embodiment, the fiberglass comprises one of E-glass filaments and S-glass filaments.

In an exemplary embodiment, a system for filling a muffler with a fibrous material is provided. The muffler includes a muffler shell having an inlet port and an outlet port. The muffler shell comprises a first shell member and a second shell member. The system comprises: means (e.g., a robot or machine) for positioning the first shell member relative to the second shell member to form an open portion and a closed portion, the open portion defining a gap sufficient to allow a filling nozzle to fit between the first shell member and the second shell member at the open portion; means (e.g., a robot or machine) for holding the first shell member and the second shell member together to maintain the open portion and the closed portion; means (e.g., a robot or machine) for inserting the filling nozzle into the muffler shell through the open portion and removing the filling nozzle from the muffler shell through the open portion; means (e.g., a robot or machine) for introducing the fibrous material into the muffler shell through the filling nozzle; means (e.g., a robot or machine) for releasing the first shell member and the second shell member from one another; means (e.g., a robot or machine) for positioning the first shell member relative to the second shell member to remove the open portion; and means (e.g., a robot or machine) for affixing the first shell member to the second shell member.

In an exemplary embodiment, two or more of the aforementioned means are integrated into a single means (e.g., a single robot or machine).

In an exemplary embodiment, the system performs a majority of the operations automatically. In an exemplary embodiment, the system performs all of the operations automatically.

In an exemplary embodiment, one or more of the aforementioned means is an operator performing the operation, or a portion thereof, manually.

In an exemplary embodiment, a method of filling a muffler with a fibrous material is provided. The muffler includes a muffler shell having an inlet port and an outlet port. The muffler shell comprises a first shell member and a second shell member. The method comprises: affixing the first shell member and the second shell member to one another to define an open portion and a closed portion, the open portion defining an opening sufficient to allow a filling nozzle to fit between the first shell member and the second shell member at the open portion; inserting the filling nozzle into the muffler shell through the open portion; introducing the fibrous material into the muffler shell through the filling nozzle; removing the filling nozzle from the muffler shell through the open portion; and closing the open portion.

In an exemplary embodiment, a plurality of open portions are defined by affixing the first shell member and the second shell member to one another.

In an exemplary embodiment, the method further comprises: evacuating air from within the muffler shell during the introduction of the fibrous material into the muffler shell. In an exemplary embodiment, the air is evacuated from within the muffler shell through at least one of the inlet port and the outlet port.

In an exemplary embodiment, the filling nozzle includes an outlet opening that is shaped to direct the fibrous material along a filling axis, wherein the filling axis differs from (i.e., is not parallel to) a central axis of the filling nozzle. In an exemplary embodiment, the filling axis forms an angle relative to the central axis of the filling nozzle within the range of 0 degrees to 90 degrees. In an exemplary embodiment, the filling axis forms an angle relative to the central axis of the filling nozzle within the range of 10 degrees to 55 degrees.

In an exemplary embodiment, the method further comprises: positioning the outlet opening at a desired filling location within the muffler shell prior to introducing the fibrous material into the muffler shell.

In an exemplary embodiment, the method further comprises: positioning the outlet opening at a first filling location within the muffler shell and introducing a first quantity of the fibrous material into the muffler shell; and positioning the outlet opening at a second filling location within the muffler shell and introducing a second quantity of the fibrous material into the muffler shell. In an exemplary embodiment, the first quantity and the second quantity are the same.

In an exemplary embodiment, the method further comprises: rotating the filling nozzle such that the outlet opening is pointed in a desired filling direction prior to introducing the fibrous material into the muffler shell.

In an exemplary embodiment, the method further comprises: moving the filling nozzle during the introduction of the fibrous material into the muffler shell.

In an exemplary embodiment, the method further comprises: rotating the filling nozzle during the introduction of the fibrous material into the muffler shell.

In an exemplary embodiment, a pipe extends between the inlet port and the outlet port, wherein at least a portion of the pipe within the muffler shell is perforated.

In an exemplary embodiment, the muffler includes a partition forming a first chamber and a second chamber within the muffler shell. In an exemplary embodiment, the inlet port interfaces with the first chamber and the outlet port interfaces with the second chamber. In an exemplary embodiment, at least a portion of the partition is perforated.

In an exemplary embodiment, a first pipe is interfaced with the inlet port and is open to the first chamber, and a second pipe is interfaced with the outlet port and is open to the second chamber. In an exemplary embodiment, at least a portion of the first pipe within the muffler shell is perforated. In an exemplary embodiment, at least a portion of the second pipe within the muffler shell is perforated.

In an exemplary embodiment, the method further comprises: inserting a first filling nozzle into the muffler shell at a first location through a first open portion; and inserting a second filling nozzle into the muffler shell at a second location through a second open portion. In an exemplary embodiment, the muffler includes a partition forming a first chamber and a second chamber within the muffler shell, wherein an outlet opening of the first filling nozzle is positioned within the first chamber and wherein an outlet opening of the second filling nozzle is positioned within the second chamber. In an exemplary embodiment, the fibrous material is introduced into the muffler shell through the first filling nozzle and the second filling nozzle simultaneously.

In an exemplary embodiment, closing the open portion comprises deforming the open portion. In an exemplary embodiment, closing the open portion comprises at least one of plugging and capping the open portion.

In an exemplary embodiment, a height of the opening is within the range of 5 mm to 20 mm; and a width of the opening is within the range of 5 mm to 20 mm.

In an exemplary embodiment, the fibrous material is fiberglass. In an exemplary embodiment, the fiberglass is texturized. In an exemplary embodiment, the fiberglass comprises one of E-glass filaments and S-glass filaments.

In an exemplary embodiment, a system for filling a muffler with a fibrous material is provided. The muffler includes a muffler shell having an inlet port and an outlet port. The muffler shell comprises a first shell member and a second shell member. The system comprises: means (e.g., a robot or machine) for affixing the first shell member and the second shell member to one another to define an open portion and a closed portion, the open portion defining an opening sufficient to allow a filling nozzle to fit between the first shell member and the second shell member at the open portion; means (e.g., a robot or machine) for inserting the filling nozzle into the muffler shell through the open portion; means (e.g., a robot or machine) for introducing the fibrous material into the muffler shell through the filling nozzle; means (e.g., a robot or machine) for removing the filling nozzle from the muffler shell through the open portion; and means (e.g., a robot or machine) for closing the open portion.

In an exemplary embodiment, two or more of the aforementioned means are integrated into a single means (e.g., a single robot or machine).

In an exemplary embodiment, the system performs a majority of the operations automatically. In an exemplary embodiment, the system performs all of the operations automatically.

In an exemplary embodiment, one or more of the aforementioned means is an operator performing the operation, or a portion thereof, manually.

Numerous other aspects, advantages, and/or features of the general inventive concepts will become more readily apparent from the following detailed description of exemplary embodiments, from the claims, and from the accompanying drawings being submitted herewith.

BRIEF DESCRIPTION OF THE DRAWINGS

The general inventive concepts as well as embodiments and advantages thereof are described below in greater detail, by way of example, with reference to the drawings in which.

DETAILED DESCRIPTION

Figure 1:
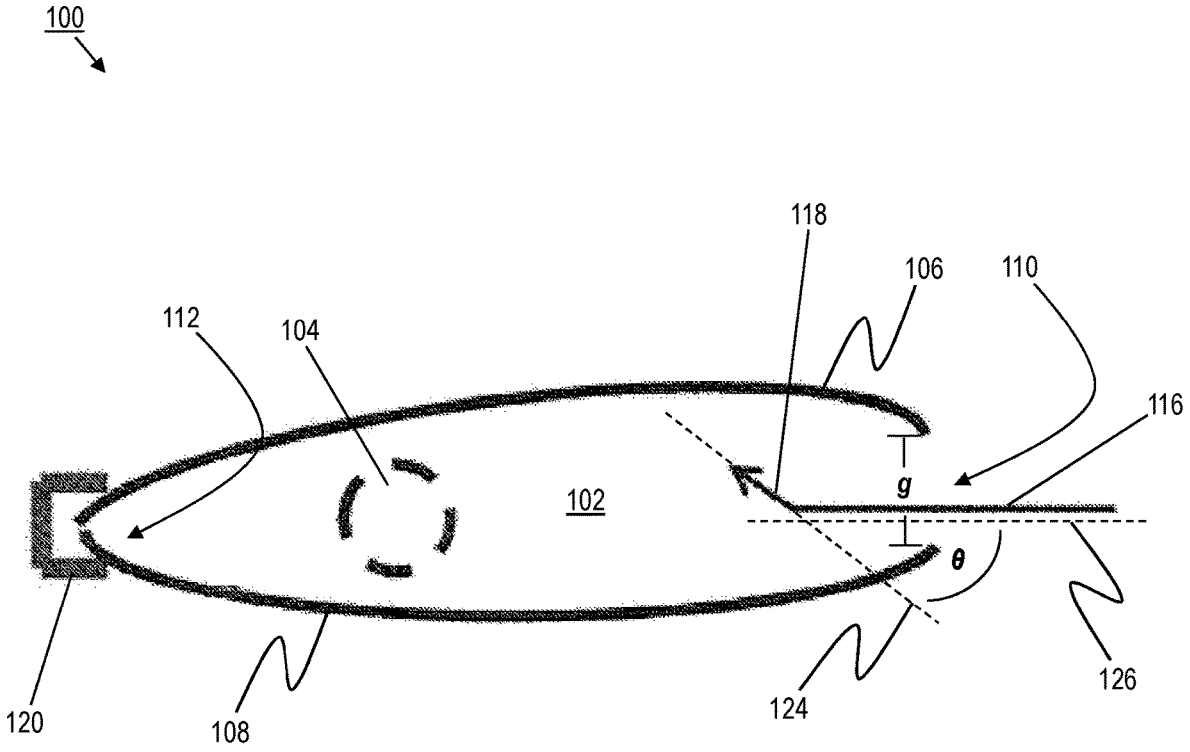
FIG. 1 is a schematic diagram of a muffler assembly for describing a filling method according to an exemplary embodiment.

While the general inventive concepts are susceptible of embodiment in many different forms, there are shown in the drawings, and will be described herein in detail, specific embodiments thereof with the understanding that the present disclosure is to be considered as an exemplification of the principles of the general inventive concepts. Accordingly, the general inventive concepts are not intended to be limited to the specific embodiments illustrated herein.

Referring now to the drawings, there is illustrated in FIG. 1 a schematic diagram to illustrate various aspects of the general inventive concepts. In FIG. 1, a muffler assembly 100 includes a muffler shell 102. The muffler shell 102 is a housing, body, or the like that defines a cavity therein. The muffler shell 102 includes an inlet port 104 and an outlet port (not shown). The inlet port 104 and the outlet port are in communication with the cavity of the muffler shell 102. In this manner, exhaust gases may enter the cavity through the inlet port 104 and exit the cavity through the outlet port.

In some embodiments, a pipe (not shown) extends between the inlet port 104 and the outlet port. At least a portion of the pipe is typically perforated to allow passage of gases through the pipe and into the cavity. Because at least a portion of the cavity is filled with a fibrous material (e.g., texturized fiberglass), sound that would otherwise be produced by the exhaust gases can be absorbed and attenuated by the fibrous material as the exhaust gases pass through the muffler assembly 100.

In some embodiments, the muffler shell 102 includes one or more internal partitions, walls, or the like that divide the cavity into two or more discrete chambers. The internal partitions will typically constrain the fibrous material. In some embodiments, the cavity is divided into two chambers. In some embodiments, the cavity is divided into more than two chambers.

In some embodiments, the inlet port 104 is interfaced with or otherwise open to a first chamber, while the outlet port is interfaced with or otherwise open to a second chamber. In some embodiments, the muffler assembly 100 may include a plurality of inlet ports and/or a plurality of outlet ports. In some embodiments, the muffler assembly 100 may include an opening that is neither an inlet port nor an outlet port, but is instead used for some other function (e.g., evacuation of air from within the muffler shell 102 during the introduction of the fibrous material into the muffler shell 102).

In some embodiments, a first pipe is interfaced with the inlet port 104 and extends into the first chamber, while a second pipe is interfaced with the outlet port and extends into the second chamber. In some embodiments, at least a portion of the first pipe in the first chamber is perforated. In some embodiments, at least a portion of the second pipe in the second chamber is perforated. It will be appreciated by one of skill in the art that additional muffler pipes may be included in the muffler assembly 100. For example, a muffler assembly may include multiple inlet or outlet pipes, or a combination of inlet and outlet pipes, dependent upon the muffler design.

In some embodiments, a pipe will extend through multiple chambers within the cavity of the muffler shell 102. In such a case, the internal partitions defining the chambers will have corresponding openings through which the pipe may pass. In some embodiments, a pipe extending through multiple chambers will have a first perforated portion corresponding to one chamber and a second perforated portion corresponding to a different chamber.

In some embodiments, the muffler assembly 100 is a clamshell muffler that comprises a first shell member 106 (e.g., upper body) and a second shell member 108 (e.g., lower body) that together form the muffler shell 102.

A method of filling the muffler assembly 100 (in the form of a clamshell muffler) with a fibrous material will now be described with reference to FIG. 1. According to the general inventive concepts, the fibrous material is introduced into the muffler shell prior to the muffler assembly 100 being sealed (i.e., prior to the first shell member 106 and the second shell member 108 being affixed to one another, such as by welding, crimping, or some other suitable means).

Prior to introducing the fibrous material into the muffler shell 102, the first shell member 106 is positioned relative to the second shell member 108 such that an open portion 110 and a closed portion 112 are formed. The open portion 110 defines a gap g of sufficient size to allow a filling nozzle 116 to fit between the first shell member 106 and the second shell member 108. In other words, the open portion 110 is that portion of the circumference of the muffler shell 102 wherein the shell members 106, 108 are so spaced as to allow the filling nozzle 116 to fit between the shell members 106, 108 and into the cavity of the muffler shell 102. Conversely, the closed portion 112 is that portion of the circumference of the muffler shell 102 wherein the shell members 106, 108 are so spaced as to not allow the filling nozzle 116 to fit between the shell members 106, 108 and into the cavity of the muffler shell 102. Together, the open portion 110 and the closed portion 112 are approximately equal to the circumference of the muffler shell 102.

The general inventive concepts contemplate that the size of the gap g could be increased or decreased to account for different filling nozzle dimensions/configurations. In general, the gap g is typically kept small or otherwise minimized to facilitate retention of the fibrous material within the cavity of the muffler shell 102 during filling. In some embodiments, the gap g defining the open portion 110 is within the range of 5 mm to 20 mm. In some embodiments, the gap g defining the open portion 110 is within the range of 12 mm to 14 mm.

Once the first shell member 106 is positioned relative to the second shell member 108, as described above, a holding element 120 (e.g., a clamp, spacer, bracket) is interfaced with the muffler shell 102 such that an orientation and position of the first shell member 106 and the second shell member 108 are fixed relative to one another. In this manner, the open portion 110 and the closed portion 112 are substantially maintained during subsequent processing (e.g., introduction of the fibrous material into the cavity). It will be appreciated by one of skill in the art that the general inventive concepts encompass any means and corresponding structure (including the aforementioned holding element) suitable for maintaining the open and closed portions 110, 112. In some embodiments, the holding element 120 comprises one or more clamps (e.g., C-clamps).

The holding element 120 will typically be substantially perpendicular to at least one partition of the muffler shell 102 (see, e.g., FIGS. 2-5, 7-8, and 10). In some embodiments, the holding element 120 is substantially perpendicular to all partitions of the muffler shell 102. In some embodiments, the holding element 120 forms an angle with at least one partition of the muffler shell 102 within the range of 80 to 100 degrees (see, e.g., FIG. 6). In some embodiments, the holding element 120 forms an angle with each partition of the muffler shell 102 within the range of 80 to 100 degrees. In some embodiments, the holding element 120 forms an angle with at least one partition of the muffler shell 102 of greater than 45 degrees. In some embodiments, the holding element 120 forms an angle with each partition of the muffler shell 102 of greater than 45 degrees. In some embodiments, the holding element 120 is positioned to be non-parallel to at least one partition of the muffler shell 102. In some embodiments, the holding element 120 is positioned to be non-parallel to each partition of the muffler shell 102.

In some embodiments, the initial positioning of the shell members 106, 108 and/or a repositioning of the shell members 106, 108 may take place after the shell members 106, 108 are fixed to one another.

In some embodiments, the method utilizes a plurality of holding elements. For example, in some embodiments, a first holding element is placed at a first location of the closed portion 112, and a second holding element is placed at a second location of the closed portion 112. Given that mufflers come in a variety of shapes and sizes, the use of different types and numbers of holding elements are contemplated by the general inventive concepts to the extent needed to maintain the open and closed portions 110, 112.

With the shell members 106, 108 appropriately positioned and fixed, the filling nozzle 116 is inserted into the cavity of the muffler shell 102 through the open portion 110.

The filling nozzle 116 is any structure suitable for conveying the fibrous material from a supply of the fibrous material to an intended destination within the muffler shell 102. In some embodiments, the filling nozzle 116 is a tubular member having a bent, angled, or otherwise shaped outlet opening 118 that directs the fibrous material as it exits the filling nozzle 116. In FIG. 1, the arrow at the outlet opening 118 is intended to illustrate the direction in which the fibrous material is delivered into the muffler shell 102. The outlet opening 118 directs the fibrous material along a filling axis 124, wherein the filling axis 124 typically differs from (i.e., is not parallel to) a central axis 126 of the filling nozzle 116.

The filling axis 124 forms an angle θ relative to the central axis 126 of the filling nozzle 116. Any angle θ suitable for introducing the fibrous material into the muffler shell 102 can be used. In some embodiments, the angle θ is within the range of 0 to 90 degrees. In some embodiments, the angle θ is within the range of 10 to 55 degrees. In some embodiments, the angle θ is within the range of 20 to 45 degrees. In some embodiments, the angle θ is approximately 20 degrees. In some embodiments, the angle θ is approximately 45 degrees.

In some embodiments, the filling nozzle is part of a texturizing device (e.g., gun) that expands the fibrous material, such as a continuous strand of glass fiber, for delivery out the outlet opening 118 of the filling nozzle 116.

The filling nozzle 116 is positioned such that the outlet opening 118 is at a desired filling location within the muffler shell 102.

In some embodiments, movement of the filling nozzle 116 is restricted to one axis (e.g., horizontal movement along the x axis). In some embodiments, the filling nozzle 116 is operable to move along two axes (e.g., horizontal movement along the x axis and vertical movement along the y axis). In some embodiments, the filling nozzle 116 is operable to move along several axes (e.g., the x, y, and z axes).

In some embodiments, the filling nozzle 116 is operable to rotate around its central axis 126. In this manner, the filling axis 124 can be varied through 360 degrees around the central axis 126.

In some embodiments, the filling nozzle 116 is fixed, and the intermediate muffler assembly 100, as described above, is moved onto the filling nozzle 116.

In some embodiments, the filling nozzle 116 is positioned in the muffler shell 102 manually.

In some embodiments, more precise and/or consistent placement of the filling nozzle 116 is effected by automating the insertion of the filling nozzle 116 into the muffler shell 102 through the open portion 110. For example, the filling nozzle 116 can be attached to a robot arm/wrist, linear actuator, or other device capable of executing precision movements. In this manner, the step of inserting the filling nozzle 116 into the muffler shell 102 can be automated. It is worth noting that some or all of the other method steps could also be automated. Accordingly, the general inventive concepts not only provide methods that provide more control over the delivery of a fibrous material into a muffler, but may actually lead to more efficient processing (e.g., increased throughput).

Once the filling nozzle 116 is positioned such that the outlet opening 118 is at a desired filling location within the muffler shell 102 and rotated such that the outlet opening 118 has assumed a desired filling axis 124, the fibrous material is introduced into the cavity of the muffler shell or some portion thereof (e.g., a particular chamber) through the filling nozzle 116. The fibrous material is introduced into the cavity or portion thereof such that a desired fill quantity is achieved. In some embodiments, the desired fill quantity is between 50 g to 5 kg.

The fibrous material may be any material suitable for absorbing and attenuating the sounds produced by exhaust gases, such as those produced by an internal combustion engine. In some embodiments, the fibrous material is fiberglass. In some embodiments, the fiberglass includes one of E-glass filaments and S-glass filaments. In some embodiments, the fibrous material is a continuous strand of fiberglass that has been texturized as known in the art. The fibrous material will generally have a particular density (e.g., between 50 g/L and 200 g/L).

In some embodiments, a single filling nozzle 116 is used to introduce the fibrous material into the cavity of the muffler shell 102. In some embodiments, the filling nozzle 116 introduces the fibrous material into the cavity at a single location. In some embodiments, the filling nozzle 116 introduces a first fill quantity of the fibrous material at a first location within the muffler shell 102 and then moves to a second location where the filling nozzle 116 then introduces a second fill quantity of the fibrous material within the muffler shell 102. The first fill quantity and the second fill quantity may or may not be the same. The repositioning of the filling nozzle 116 can occur as many times as necessary to achieve a desired fill state for the muffler assembly 100.

In some embodiments, the filling nozzle 116 introduces a first fill quantity of the fibrous material along a first filling axis 124 at a first location within the muffler shell 102 and then is rotated to assume a second filling axis 124 at the first location where the filling nozzle 116 then introduces a second fill quantity of the fibrous material within the muffler shell 102. The first fill quantity and the second fill quantity may or may not be the same. The rotating of the filling nozzle 116 at the same location can occur as many times as necessary to achieve a desired fill state for the muffler assembly 100.

In some embodiments, the filling nozzle 116 is rotated while introducing a fill quantity of the fibrous material within the muffler shell 102.

In some embodiments, two or more filling nozzles 116 are used to introduce the fibrous material into the cavity of the muffler shell 102. Instead of or in addition to being at different locations, the filling nozzles 116 may have different filling axes 124. Thus, the method can provide for more control over the introduction of the fibrous material into the cavity without requiring as much, if any, intra-cavity movement of the filling nozzles 116, which can lead to a more even and/or a more effective distribution of the fibrous material within the muffler assembly 100. In some embodiments, the fibrous material may be introduced into two different portions of the same chamber simultaneously resulting in more efficient filling of the muffler assembly 100. In some embodiments, the fibrous material may be introduced into two different chambers simultaneously resulting in more efficient filling of the muffler assembly 100.

In some embodiments, to facilitate introduction of the fibrous material into the cavity and/or distribution of the fibrous material within the cavity or portion thereof, the method further comprises evacuating air from within the muffler shell 102 during the filling step. Accordingly, a means for removing air from the cavity of the muffler shell 102 (e.g., a suction device) can be interfaced with the intermediate muffler assembly 100, as described above. In some embodiments, the air removal means is interfaced with the inlet port 104 of the muffler shell 102. In some embodiments, the air removal means is interfaced with the outlet port of the muffler shell 102.

Once the introduction of the fibrous material into the cavity of the muffler shell 102 is complete, i.e., once the desired fill state is achieved, all filling nozzles 116 are removed from the muffler shell 102 through the open portion 110. The holding element 120 is then removed or otherwise disengaged such that the shell members 106, 108 may more readily move relative to one another. Thereafter, the first shell member 106 and the second shell member 108 are positioned relative to one another to remove the open portion 110. In this manner, the entire circumference of the muffler shell 102 becomes a closed portion 112.

In some embodiments, positioning of the first shell member 106 and the second shell member 108 relative to one another to remove the open portion 110 takes place at a controlled rate to prevent or otherwise reduce disruption or migration of the fibrous material within the muffler shell 102 during the closing operation. In other words, closing of the shell members 106, 108 takes place at a relatively slow rate of speed. For example, in some embodiments, the shell members 106, 108 are closed (i.e., the gap g is reduced) at a rate no faster than 5-10 mm/sec.

It will be appreciated by one of skill in the art that the systems may include other structure for performing various other aspects of the methods described herein. For example, the means described above may include a suction device, vacuum source, or the like for removing air from the cavity of the muffler shell 102 during the filling operation.

For example, in some embodiments, application of vacuum (i.e., application of a negative pressure) within the muffler shell 102 is maintained through removal of the nozzle(s) and closing of the shell members 106, 108. This too serves to prevent or otherwise reduce disruption or migration of the fibrous material within the muffler shell 102 (e.g., during the closing operation).

The muffler assembly 100 is then fashioned by affixing the first shell member 106 and the second shell member 108 to one another. The shell members 106, 108 may be affixed to one another using any suitable means. In some embodiments, the shell members 106, 108 are affixed to one another by welding. In some embodiments, the shell members 106, 108 are affixed to one another by crimping.

In some embodiments, the shell members 106, 108 may be not be permanently affixed to one another immediately after closing of the shell members 106, 108. For example, the closed assembly (i.e., the closed, but not yet sealed, shell members 106, 108) may need to be transported to a different location for sealing (e.g., welding, crimping). Accordingly, in some embodiments, a closing element is used to temporarily maintain the closed relationship of the shell members 106, 108. The closing element can be any suitable mechanism for maintaining the closed relationship of the shell members 106, 108. In some embodiments, the closing element comprises one or more of an elastomeric member (e.g., rubber band), an adhesive member (e.g., tape), a clamp, and the like. In some embodiments, the closing element is removed once the shell members 106, 108 are sealed. In some embodiments, the closing element is not removed once the shell members 106, 108 are sealed. In some embodiments, the holding element may be used as the closing element, or at least a part thereof. The closing element acts to prevent accidental separation (i.e., opening) of the shell members 106, 108 prior to sealing of the shell members 106, 108.

The aforementioned filling methods lend themselves to being readily automated. In particular, for a specified muffler type (with known dimensions/geometry) that is held in a predetermined orientation, it is possible to indicate the desired filling location for each filling nozzle 116 relative to the muffler by indicating the movements (e.g., direction, magnitude) of the filling nozzles 116. For example, a desired filling location could be represented as +25 units along the x axis, −15 units along the y axis, and rotation of +20 degrees, all measured from a default (e.g., 0, 0, 0) location of the filling nozzle 116. If a single filling nozzle 116 is used to fill the muffler at different locations, then a time component could be added to the aforementioned representation to indicate how long the initial filling operation should be performed before the filling nozzle 116 is moved to the next desired location. Thus, a representation of (+25, −15, +20, 60) would move the filling nozzle 116 as noted above and then perform the filling operation for 60 seconds before moving to the next location, if any. Subsequent locations could be measured from the preceding location as opposed to the initial default location. In the case of multiple filling nozzles 116, each could be moved independently of the others. As noted above, the different filling nozzles 116 could be used to deliver the same or different fibrous materials. Furthermore, the different filling nozzles 116 could be used to deliver fibrous materials over different durations of time. Either or both of these techniques can facilitate introducing different densities of fibrous material into different areas in the cavity of the muffler shell 102. In this manner, a filling "program" can be created and used to control a robot or other automaton to perform the filling methods described herein.

The general inventive concepts contemplate corresponding systems for performing the methods described or otherwise suggested herein, including systems for filling the muffler assembly 100 (in the form of a clamshell muffler), as shown in FIG. 1, with a fibrous material. In general, these systems include sufficient structure, as known in the art, to automate one or more steps of the methods.

In some embodiments, the systems include means for positioning the first shell member 106 relative to the second shell member 108 to form the open portion 110 and the closed portion 112. The open portion 100 defines the gap g which is sufficient to allow a filling nozzle to fit between the shell members 106, 108 at the open portion 110. In some embodiments, the means for positioning is a machine (e.g., a robot or other automaton) operable to receive the shell members 106, 108; orient the shell members 106, 108; and manipulate the shell members 106, 108 into the desired position. The machine may include sensors for determining when the open portion 110 has achieved a suitable gap g. In some embodiments, multiple machines are used to perform various aspects of this step. In some embodiments, the positioning of the shell members 106, 108 may be done manually.

In some embodiments, the systems also include means for fixing the shell members 106, 108 to one another to maintain the open portion 110 and the closed portion 112. The means for fixing applies a holding element 120 or any other structure suitable for removably or temporarily holding the shell members 106, 108 relative to one another such that the open portion 110 and the closed portion 112 are maintained for as long as the holding element 120 is applied. In some embodiments, the means for fixing is a machine (e.g., a robot or other automaton) operable to apply the holding element 120 to the positioned shell members 106, 108. In some embodiments, such as when multiple holding elements are applied, multiple machines can be used to increase overall efficiency. In some embodiments, the fixing of the shell members 106, 108 may be done manually.

In some embodiments, the systems include means for inserting/removing the filling nozzle 116 into/from the muffler shell 102 through the open portion 110. As noted above, precise positioning of the filling nozzle 116 is a preferred aspect of the general inventive concepts. Accordingly, in some embodiments, the means for inserting/removing the filling nozzle 116 is a machine (e.g., a robot or other automaton) operable to precisely position the filling nozzle 116 such that the outlet opening 118 is situated in the cavity of the muffler shell 102 at a desired location and with a desired filling axis 124.

As described herein, a filling "program" can be used to control the machine to move one or more filling nozzles 116 through a series of movements and filling operations as the fibrous material is introduced into the cavity or portion thereof of the muffler shell 102. Accordingly, in some embodiments, the machine includes one or more motors, servos, or the like for effecting automatic movement of the filling nozzles 116. In some embodiments, the inserting and/or removing of one or more filling nozzles 116 may be done manually.

Accordingly, the filling methods, systems, and programs, as described herein, allow a particular sequence of fibrous material portions to be introduced into the cavity or portion thereof of the muffler shell 102 at specific locations. For example, controlling the fibrous material portions can involve the controlled/directed introduction of the fibrous material into the cavity, the controlled/directed application of vacuum, etc. In this manner, different fibrous material portions can be caused to join with one another to "wall off" the open portion during the filling operation. As a result, the fibrous material actually forms a barrier that is able to prevent other fibrous material from extending into the open portion from the cavity.

In some embodiments, the systems include means for introducing the fibrous material into the muffler shell 102. As described herein, the filling nozzle 116 will typically be this means or a part thereof. In some embodiments, the means for introducing the fibrous material into the muffler shell 102 is, in whole or in part, a texturizing device that expands a strand of the fibrous material, such as a continuous strand of glass fiber. For example, the texturizing device disclosed in U.S. Pat. No. 5,976,453, the disclosure of which is incorporated herein in its entirety by reference, could be used as at least part of the means.

In some embodiments, the systems include means for closing the shell members 106, 108, i.e., means for positioning the first shell member 106 relative to the second shell member 108 to remove the open portion 110. This means can be the same as the aforementioned means for creating the open portion 110 and the closed portion 112. In some embodiments, removal of the holding element 120 is sufficient to remove the open portion 110. In some embodiments, additional manipulation of the shell members 106, 108 may be necessary. In some embodiments, the means for closing the muffler shell 102 is a machine (e.g., a robot or other automaton) operable to remove the holding element 120 and, if necessary, adjust or otherwise move the shell members 106, 108 such that the entire circumference of the muffler shell is a closed portion 112. In some embodiments, the machine is able to control the rate at which the shell members 106, 108 are closed (e.g., imposing a closing speed limit of no faster than 10 mm/sec.). The machine may include sensors for determining that no open portion 110 remains. In some embodiments, such as when multiple holding elements 120 were used, multiple machines can be used to perform various aspects of this step. In some embodiments, the closing of the muffler shell 102 may be done manually.

In some embodiments, means for applying a vacuum (i.e., a negative pressure) is used to withdraw air from within the muffler shell 102 while the shell members 106, 108 are being closed. Consequently, as the shell members 106, 108 become more closed (i.e., as a size of the gap g decreases), the speed of the air being withdrawn from the muffler shell 102 increases. As a result of this increased air speed, the closing of the shell members 106, 108 tends to cause any stray fibers which may have extended into the open portion to be sucked back inside the cavity 208 or portion thereof.

Finally, the systems will typically include means for sealing the muffler shell 102, i.e., means for affixing the first shell member 106 to the second shell member 108, after the filling operation is complete. The muffler shell 102 may be sealed in any manner suitable to hold the shell members 106, 108 together in a permanent fashion. In some embodiments, the means for sealing the muffler shell 102 is a machine (e.g., a robot or other automaton) operable to weld the first shell member 106 and the second shell member 108 to one another. In some embodiments, the means for sealing the muffler shell 102 is a machine (e.g., a robot or other automaton) operable to crimp the first shell member 106 and the second shell member 108 to one another. In some embodiments, the sealing operation of the muffler shell 102 may be done manually (e.g., by an operator using a welding unit or a crimping tool).

In some embodiments, the systems may include means for holding the filled and closed, but not yet sealed, shell members 106, 108 together, such as during transport to a different location for sealing (e.g., welding, crimping). In some embodiments, the means for holding the muffler shells 106, 108 together is a machine (e.g., a robot or other automaton) operable to apply a closing element to at least temporarily maintain the closed relationship of the shell members 106, 108. The closing element can be any suitable mechanism for maintaining the closed relationship of the shell members 106, 108. In some embodiments, the closing element comprises one or more of an elastomeric member (e.g., rubber band), an adhesive member (e.g., tape), a clamp, and the like. In some embodiments, the closing element is removed once the shell members 106, 108 are sealed. In some embodiments, the closing element is not removed once the shell members 106, 108 are sealed. In some embodiments, the holding element may be used as the closing element, or at least a part thereof. The closing element acts to prevent accidental separation (i.e., opening) of the shell members 106, 108 prior to sealing of the shell members 106, 108.

It will be appreciated by one of skill in the art that the systems may include other structure for performing various other aspects of the methods described herein. For example, the means described above may include a suction device, vacuum source, or the like for removing air from the cavity of the muffler shell 102 during the filling operation.

Various aspects of the general inventive concepts, including the exemplary muffler filling methods and systems described above, will be further explained with reference to or otherwise better understood from examination of the various exemplary muffler assemblies shown in FIGS. 2-10.

Figure 2:
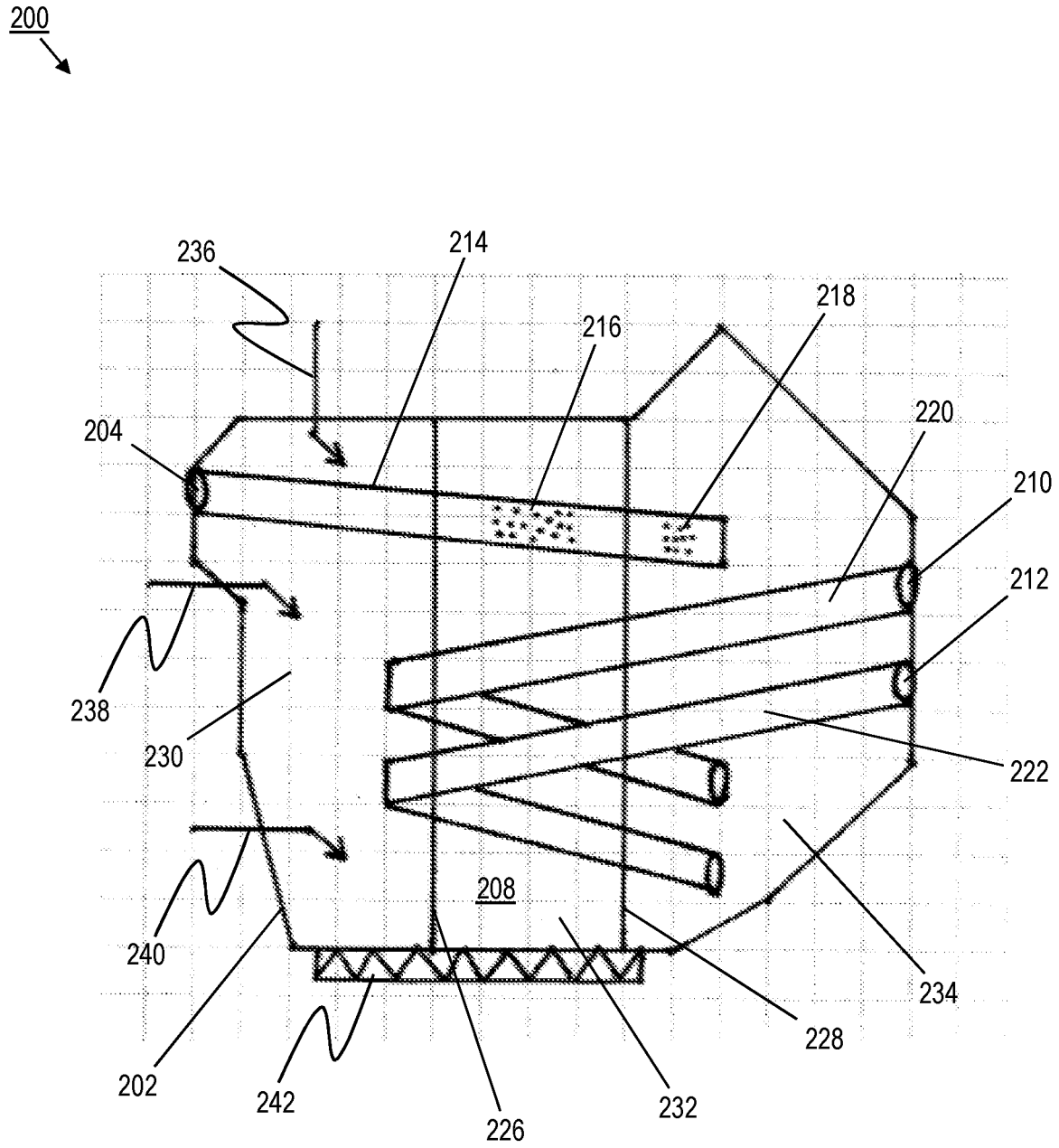
FIG. 2 is a cutaway diagram of a muffler assembly, according to an exemplary embodiment, for describing a filling operation.

In FIG. 2, a muffler assembly 200 includes a muffler shell 202. The muffler shell 202 is a housing, body, or the like that defines a cavity 208 therein. The muffler shell 202 comprises at least two housing members that are eventually joined to form the muffler assembly 200. For example, the muffler assembly 200 can be a two-piece clamshell muffler that comprises a first shell member (e.g., upper body) and a second shell member (e.g., lower body) that together form the muffler shell 202.

The muffler shell 202 includes an inlet port 204, a first outlet port 210, and a second outlet port 212. The inlet port 204 and the outlet ports 210, 212 are in communication with the cavity 208 of the muffler shell 202. In this manner, exhaust gases may enter the cavity 208 through the inlet port 204 and exit the cavity 208 through the outlet ports 210, 212.

The muffler assembly 200 includes an inlet pipe 214 that extends between or through the inlet port 204 and into the cavity 208. The inlet pipe 214 functions to deliver gases into the muffler assembly 200. A first portion 216 and a second portion 218 of the inlet pipe 214 are perforated to allow passage of gases through the perforations of the inlet pipe 214 and into the cavity 208. The muffler assembly also includes a first outlet pipe 220 and a second outlet pipe 222. The first outlet pipe 220 extends between or through the first outlet port 210 and into the cavity 208. The second outlet pipe 222 extends between or through the second outlet port 212 and into the cavity 208. The outlet pipes 220, 222 function to deliver (i.e., exhaust) gases out of the muffler assembly 200.

Because at least a portion of the cavity 208 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 208 via the inlet pipe 214 and the outlet pipes 220, 222.

The pipes may have any suitable shape and size (e.g., length, circumference). The pipes may be formed from a single piece of material or from multiple component pieces fastened together using any suitable method, as is required by the design of the pipe and/or the muffler assembly 200. The amount of perforated sections of a pipe (e.g., the inlet pipe 214) may vary depending upon the specific muffler design. It will also be appreciated by one of skill in the art that the perforations may be of any suitable shape, size, and distribution along the pipe. In some embodiments, the perforations are circular apertures having individual diameters within the range of from 3 mm to 5 mm. In some embodiments, one or more pipes can have no perforated sections. In some embodiments, one or more pipes can be entirely perforated.

The muffler shell 202 includes a first partition 226 and a second partition 228 that divide the cavity 208 into a first chamber 230, a second chamber 232, and a third chamber 234. In some embodiments, the volume of each chamber 230, 232, 234 is different. Typically, each partition will restrict movement of the fibrous material from one chamber to another.

The partitions 226, 228 can be formed using any suitable method to be of any shape and size suitable for forming the chambers 230, 232, 234 within the muffler shell 202. The partitions 226, 228 can be made from any suitable material, such as metal or composite materials. In some embodiments, one or more of the partitions 226, 228 includes perforations (not shown) throughout the entire partition or some portion thereof. In this manner, air being drawn through the perforations in the partition (e.g., by application of a vacuum source) can be used to further control the fill pattern and distribution of the fibrous material being introduced into the cavity 208 or a portion thereof.

It will be appreciated by one of skill in the art that there may be any number of partitions forming any number of chambers as required by the specific muffler design. The partitions 226, 228 may also contain a number of openings (not shown) that are used to support other structures (e.g., the inlet pipe 214, the outlet pipes 220, 222) within the muffler assembly 200. The number of openings in the partitions depends upon the configuration of the other structures within the muffler assembly 200, and it will be appreciated by one of skill in the art that the number and placement of such openings can vary as needed to conform to a particular design. In some embodiments, the openings in the partitions allow pipes (e.g., the inlet pipe 214, the outlet pipes 220, 222) to span across multiple chambers of the muffler assembly 200.

Various aspects of an exemplary method of filling the muffler assembly 200 with the fibrous material will now be explained.

After the shell members are positioned relative to one another, as described herein, to form an open portion and a closed portion, a holding element in the form of a clamp 242 is placed on the shell members to maintain the positioning of the shell members (i.e., to maintain the open portion and the closed portion) for subsequent filling operations.

Next, the filling nozzles are introduced into the cavity 208 of the muffler shell 202 through the open portion. As shown in FIG. 2, three filling nozzles are used to introduce the fibrous material into the cavity 208 of the muffler shell 202. In particular, a first filling nozzle 236, a second filling nozzle 238, and a third filling nozzle 240 are used. While the general inventive concepts encompass using a single filling nozzle that moves from one location to another to deliver a quantity of the fibrous material at each predetermined location, the use of multiple filling nozzles (e.g., filling nozzles 236, 238, 240) operating simultaneously at different locations can decrease the time needed to effect the desired filling of the muffler assembly 200.

Once the filling operation is completed, assembly of the muffler assembly 200 can be completed by affixing the shell members to one another.

In FIG. 2, all of the filling nozzles 236, 238, 240 are directing the fibrous material into the same chamber, i.e., the first chamber 230. In some embodiments, at least one of the filling nozzles 236, 238, 240 can introduce the fibrous material into a chamber that is different from that being filled by the other filling nozzles.

In some embodiments, at least one of the filling nozzles 236, 238, 240 can have a filling axis different than the other filling nozzles. In some embodiments, at least one of the filling nozzles 236, 238, 240 can introduce a fibrous material that differs (e.g., in type, quantity, etc.) from the fibrous material introduced by the other filling nozzles.

Figure 3:
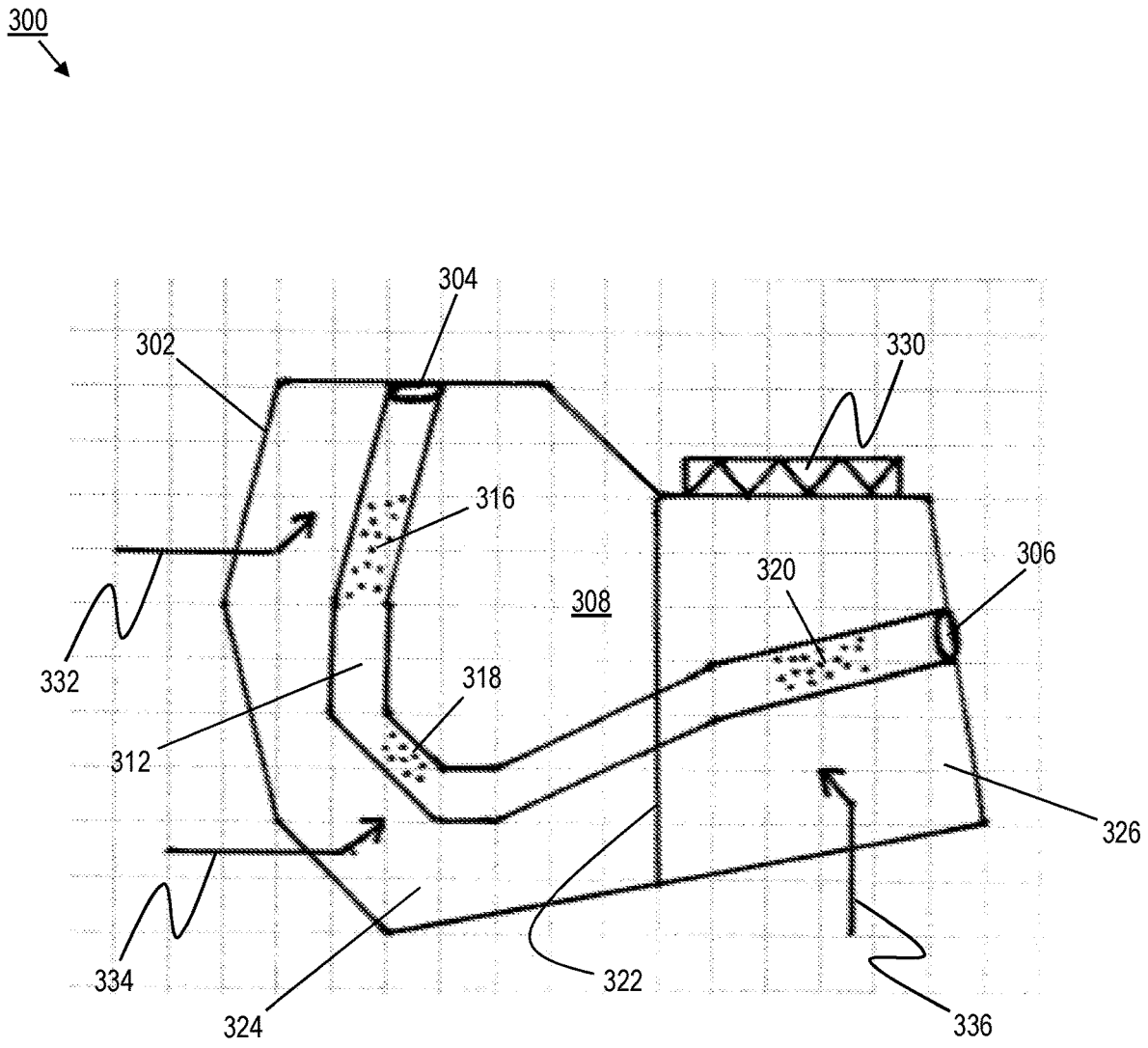
FIG. 3 is a cutaway diagram of a muffler assembly, according to an exemplary embodiment, for describing a filling operation.

In FIG. 3, a muffler assembly 300 includes a muffler shell 302. The muffler shell 302 is a housing, body, or the like that defines a cavity 308 therein. The muffler shell 302 comprises at least two housing members that are eventually joined to form the muffler assembly 300. For example, the muffler assembly 300 can be a two-piece clamshell muffler that comprises a first shell member (e.g., upper body) and a second shell member (e.g., lower body) that together form the muffler shell 302.

The muffler shell 302 includes an inlet port 304 and an outlet port 306. The inlet port 304 and the outlet port 306 are in communication with the cavity 308 of the muffler shell 302. In this manner, exhaust gases may enter the cavity 308 through the inlet port 304 and exit the cavity 308 through the outlet port 306.

The muffler assembly 300 includes a pipe 312 that extends from or through the inlet port 304, through the cavity 308, and to or through the outlet port 306. The pipe 312 functions to deliver gases into and out of the muffler assembly 300. A first portion 316, a second portion 318, and a third portion 320 of the pipe 312 are perforated to allow the gases in the pipe 312 to be exposed to the cavity 308.

Because at least a portion of the cavity 308 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 308 via the pipe 312.

The muffler shell 302 includes a partition 322 that divides the cavity 308 into a first chamber 324 and a second chamber 326. In some embodiments, the volume of the chambers 324, 326 is different. For example, the ratio of the volumes can be more than 1:1.5, more than 1:2, etc.

Various aspects of an exemplary method of filling the muffler assembly 300 with the fibrous material will now be explained.

After the shell members are positioned relative to one another, as described herein, to form an open portion and a closed portion, a holding element in the form of a clamp 330 is placed on the shell members to maintain the positioning of the shell members (i.e., to maintain the open portion and the closed portion) for subsequent filling operations.

Next, the filling nozzles are introduced into the cavity 308 of the muffler shell 302 through the open portion. As shown in FIG. 3, three filling nozzles are used to introduce the fibrous material into the cavity 308 of the muffler shell 302. In particular, a first filling nozzle 332, a second filling nozzle 334, and a third filling nozzle 336 are used. While the general inventive concepts encompass using a single filling nozzle that moves from one location to another to deliver a quantity of the fibrous material at each predetermined location, the use of multiple filling nozzles (e.g., filling nozzles 332, 334, 336) operating simultaneously at different locations can decrease the time needed to effect the desired filling of the muffler assembly 300.

Once the filling operation is completed, assembly of the muffler assembly 300 can be completed by affixing the shell members to one another.

In FIG. 3, two of the filling nozzles (i.e., filling nozzles 332, 334) are directing the fibrous material into the first chamber 324, while another of the filling nozzles (i.e., filling nozzle 336) is directing the fibrous material into the second chamber 326.

In some embodiments, at least one of the filling nozzles 332, 334, 336 can have a filling axis different than the other filling nozzles. In some embodiments, at least one of the filling nozzles 332, 334, 336 can introduce a fibrous material that differs (e.g., in type, quantity, etc.) from the fibrous material introduced by the other filling nozzles. Accordingly, the amount of the fibrous material (i.e., the fill quantity) introduced into each chamber may be the same or may be different.

Figure 4:
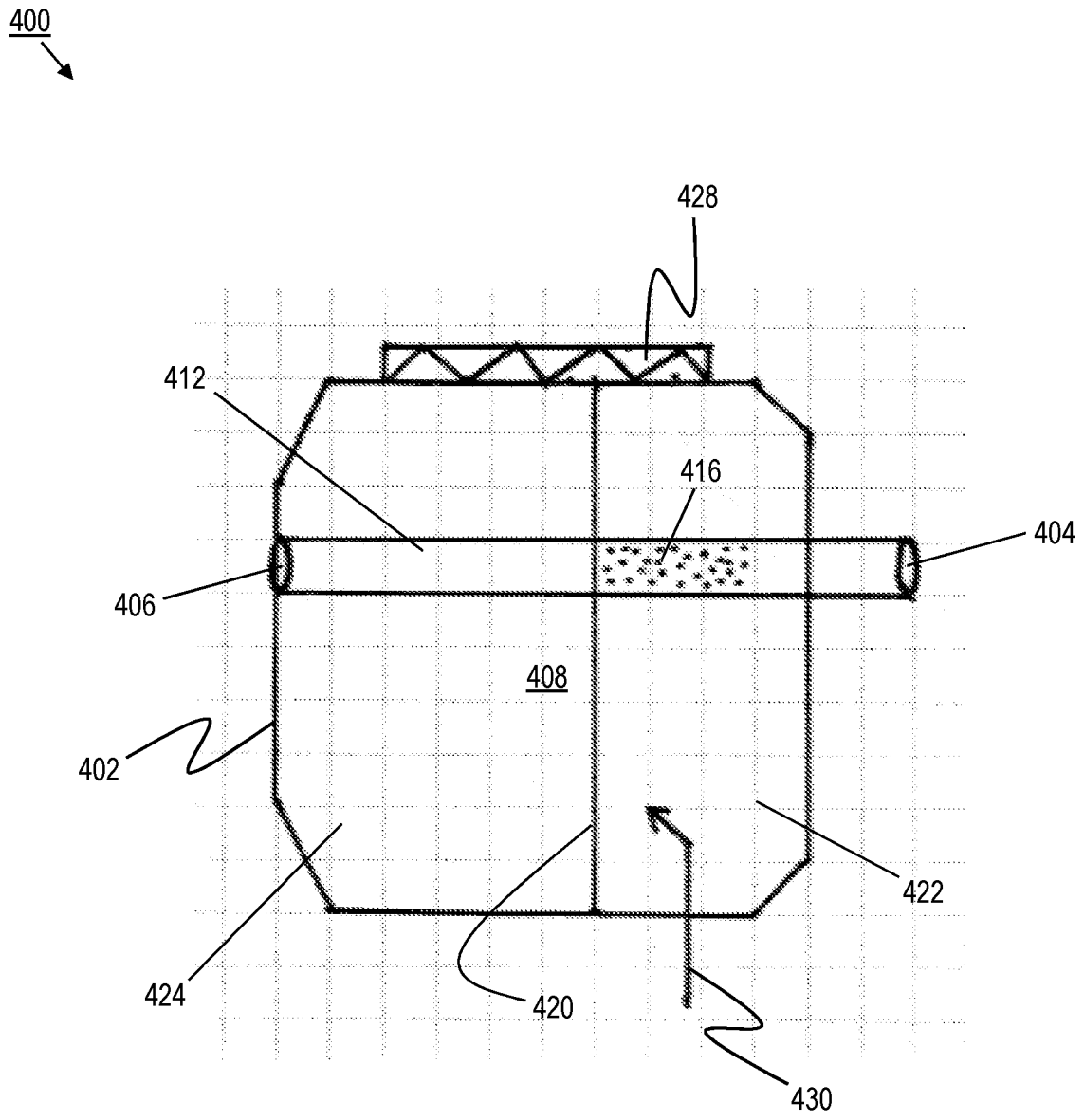
FIG. 4 is a cutaway diagram of a muffler assembly, according to an exemplary embodiment, for describing a filling operation.

In FIG. 4, a muffler assembly 400 includes a muffler shell 402. The muffler shell 402 is a housing, body, or the like that defines a cavity 408 therein. The muffler shell 402 comprises at least two housing members that are eventually joined to form the muffler assembly 400. For example, the muffler assembly 400 can be a two-piece clamshell muffler that comprises a first shell member (e.g., upper body) and a second shell member (e.g., lower body) that together form the muffler shell 402.

The muffler shell 402 includes an inlet port 404 and an outlet port 406. The inlet port 404 and the outlet port 406 are in communication with the cavity 408 of the muffler shell 402. In this manner, exhaust gases may enter the cavity 408 through the inlet port 404 and exit the cavity 408 through the outlet port 406.

The muffler assembly 400 includes a pipe 412 that extends from or through the inlet port 404, through the cavity 408, and to or through the outlet port 406. The pipe 412 functions to deliver gases into and out of the muffler assembly 400. A portion 416 of the pipe 412 is perforated to allow the gases in the pipe 412 to be exposed to the cavity 408.

Because at least a portion of the cavity 408 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 408 via the pipe 412.

The muffler shell 402 includes a partition 420 that divides the cavity 408 into a first chamber 422 and a second chamber 424. In some embodiments, the volume of the chambers 422, 424 is different. For example, the ratio of the volumes can be more than 1:1.5, more than 1:2, etc.

Various aspects of an exemplary method of filling the muffler assembly 400 with the fibrous material will now be explained.

After the shell members are positioned relative to one another, as described herein, to form an open portion and a closed portion, a holding element in the form of a clamp 428 is placed on the shell members to maintain the positioning of the shell members (i.e., to maintain the open portion and the closed portion) for subsequent filling operations.

Next, a filling nozzle 430 is moved into the cavity 408 of the muffler shell 402 through the open portion. The filling nozzle 430 is used to introduce the fibrous material into the cavity 408 of the muffler shell 402.

In some embodiments, after delivering a first quantity of the fibrous material into the first chamber 422, the filling nozzle 430 is rotated to assume a new filling axis (i.e., filling direction) without relocating the filling nozzle 430. After assuming the new filling direction, the filling nozzle 430 is used to introduce a second quantity of the fibrous material into the first chamber 422. The first quantity and the second quantity may be the same or may be different.

Once the filling operation is completed, assembly of the muffler assembly 400 can be completed by affixing the shell members to one another.

Figure 5:
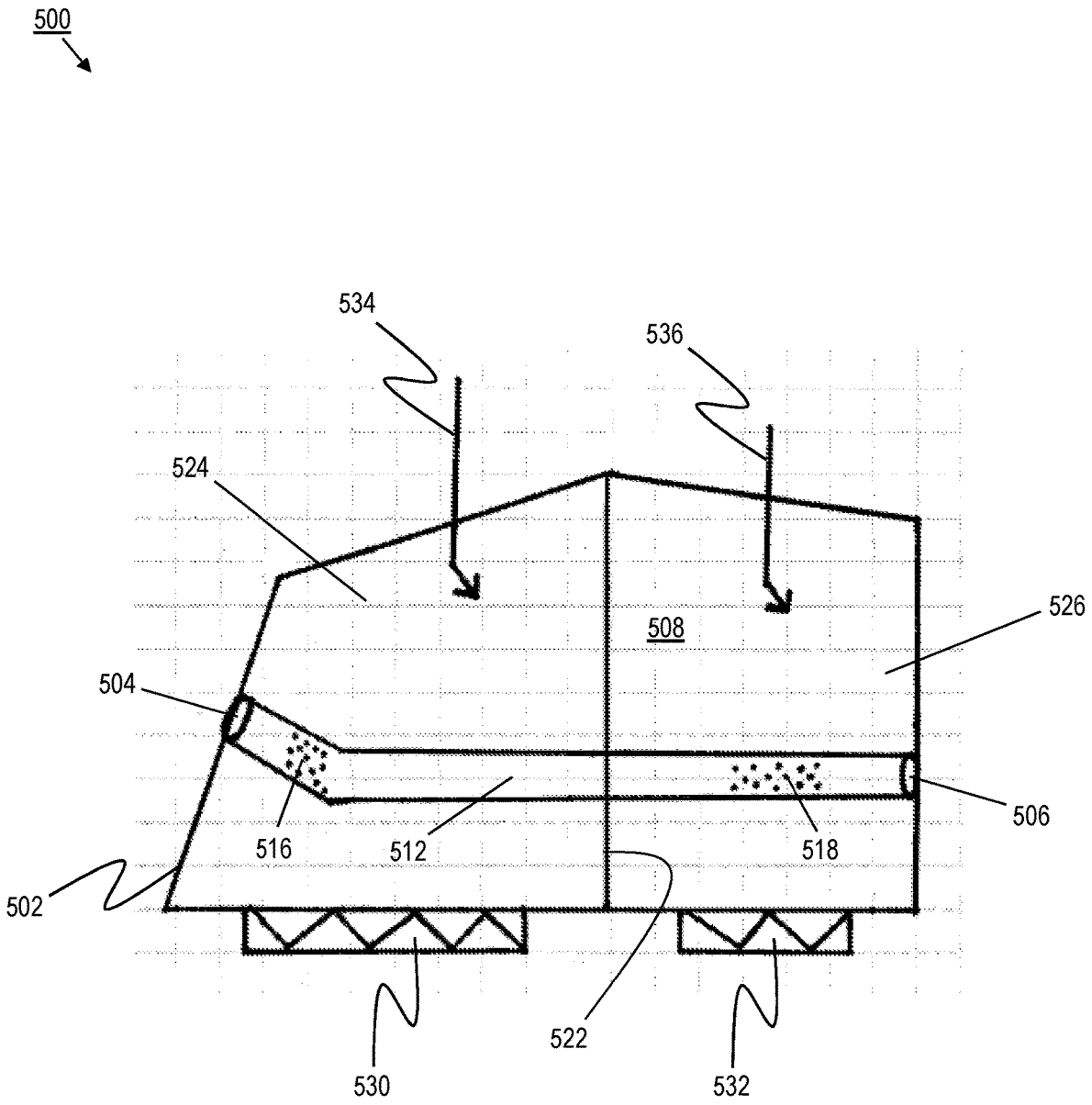
FIG. 5 is a cutaway diagram of a muffler assembly, according to an exemplary embodiment, for describing a filling operation.

In FIG. 5, a muffler assembly 500 includes a muffler shell 502. The muffler shell 502 is a housing, body, or the like that defines a cavity 508 therein. The muffler shell 502 comprises at least two housing members that are eventually joined to form the muffler assembly 500. For example, the muffler assembly 500 can be a two-piece clamshell muffler that comprises a first shell member (e.g., upper body) and a second shell member (e.g., lower body) that together form the muffler shell 502.

The muffler shell 502 includes an inlet port 504 and an outlet port 506. The inlet port 504 and the outlet port 506 are in communication with the cavity 508 of the muffler shell 502. In this manner, exhaust gases may enter the cavity 508 through the inlet port 504 and exit the cavity 508 through the outlet port 506.

The muffler assembly 500 includes a pipe 512 that extends from or through the inlet port 504, through the cavity 508, and to or through the outlet port 506. The pipe 512 functions to deliver gases into and out of the muffler assembly 500. A first portion 516 and a second portion 518 of the pipe 512 are perforated to allow the gases in the pipe 512 to be exposed to the cavity 508.

Because at least a portion of the cavity 508 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 508 via the pipe 512.

The muffler shell 502 includes a partition 522 that divides the cavity 508 into a first chamber 524 and a second chamber 526. In some embodiments, the volume of the chambers 524, 526 is different. For example, the ratio of the volumes can be more than 1:1.5, more than 1:2, etc.

Various aspects of an exemplary method of filling the muffler assembly 500 with the fibrous material will now be explained.

After the shell members are positioned relative to one another, as described herein, to form an open portion and a closed portion, a holding element comprising a first clamp 530 and a second clamp 532 is placed on the shell members to maintain the positioning of the shell members (i.e., to maintain the open portion and the closed portion) for subsequent filling operations.

Next, the filling nozzles are introduced into the cavity 508 of the muffler shell 502 through the open portion. As shown in FIG. 5, a pair of filling nozzles are used to introduce the fibrous material into the cavity 508 of the muffler shell 502. In particular, a first filling nozzle 534 and a second filling nozzle 536 are used. While the general inventive concepts encompass using a single filling nozzle that moves from one location to another to deliver a quantity of the fibrous material at each predetermined location, the use of multiple filling nozzles (e.g., filling nozzles 534, 536) operating simultaneously at different locations can decrease the time needed to effect the desired filling of the muffler assembly 300.

Once the filling operation is completed, assembly of the muffler assembly 500 can be completed by, for example, removing the clamps 530, 532 and affixing (e.g., welding, crimping) the shell members to one another.

Figure 6:
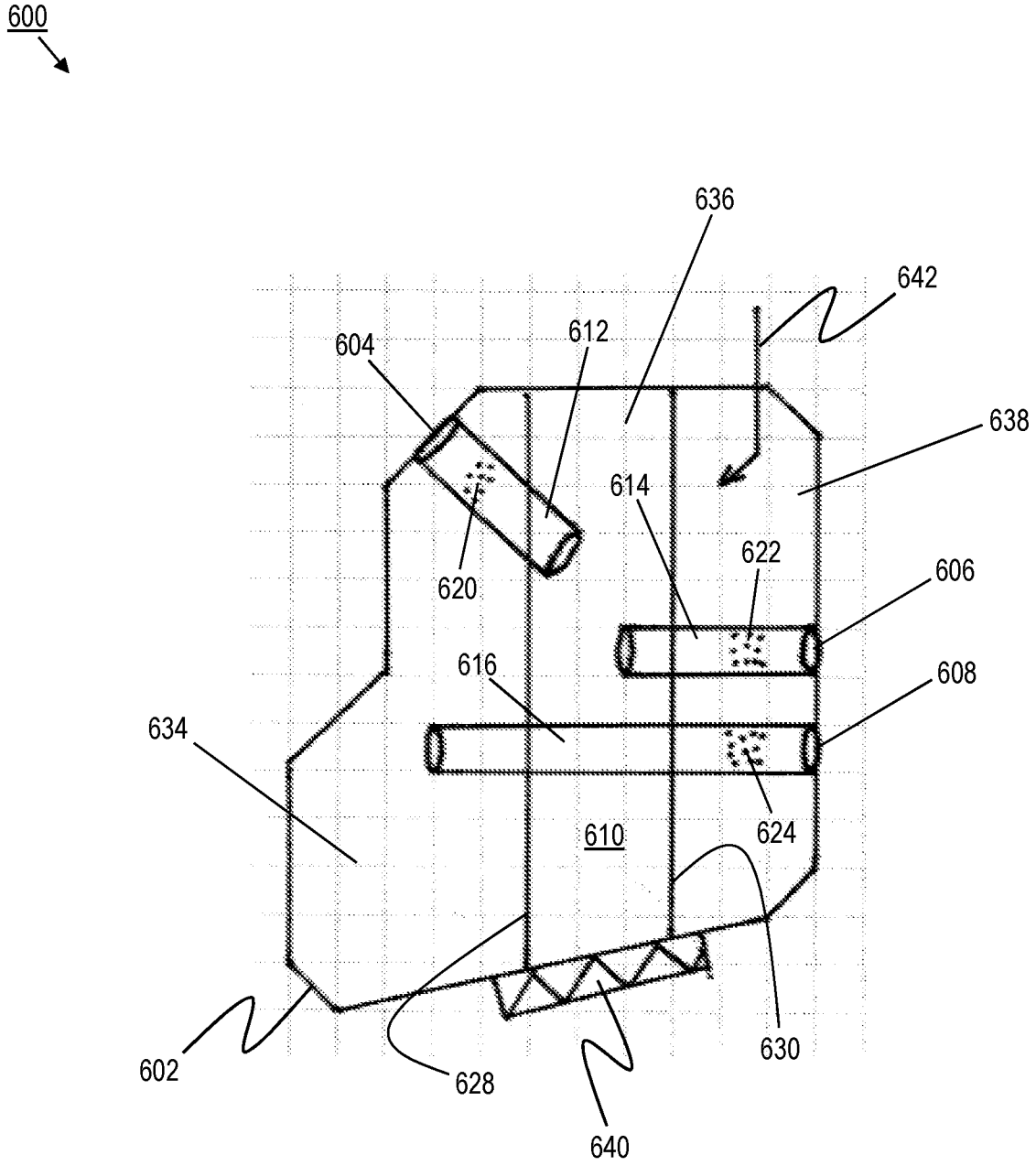
FIG. 6 is a cutaway diagram of a muffler assembly, according to an exemplary embodiment, for describing a filling operation.

In FIG. 6, a muffler assembly 600 includes a muffler shell 602. The muffler shell 602 is a housing, body, or the like that defines a cavity 610 therein. The muffler shell 602 comprises at least two housing members that are eventually joined to form the muffler assembly 600. For example, the muffler assembly 600 can be a two-piece clamshell muffler that comprises a first shell member (e.g., upper body) and a second shell member (e.g., lower body) that together form the muffler shell 602.

The muffler shell 602 includes an inlet port 604, a first outlet port 606, and a second outlet port 608. The inlet port 604 and the outlet ports 606, 608 are in communication with the cavity 610 of the muffler shell 602. In this manner, exhaust gases may enter the cavity 610 through the inlet port 604 and exit the cavity 610 through the outlet ports 606, 608.

The muffler assembly 600 includes an inlet pipe 612, a first outlet pipe 614, and a second outlet pipe 616. The inlet pipe 612 extends between or through the inlet port 604 and into the cavity 610. The first outlet pipe 614 extends between or through the first outlet port 606 and into the cavity 610. The second outlet pipe 616 extends between or through the second outlet port 608 and into the cavity 610. The pipes 612, 614, 616 function to deliver gases into and out of the muffler assembly 600. A portion 620 of the inlet pipe 612 is perforated. A portion 622 of the first outlet pipe 614 is perforated. A portion 624 of the second outlet pipe 616 is perforated. These perforated portions 620, 622, 624 allow the gases in the pipes 612, 614, 616 to be exposed to the cavity 610.

Because at least a portion of the cavity 610 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 610 via the pipes 612, 614, 616.

The muffler shell 602 includes a first partition 628 a second partition 630 that divide the cavity 610 into a first chamber 634, a second chamber 636, and a third chamber 638. In some embodiments, at least one of the chambers 634, 636, 638 has a volume that differs from the volume of the other chambers.

Various aspects of an exemplary method of filling the muffler assembly 600 with the fibrous material will now be explained.

After the shell members are positioned relative to one another, as described herein, to form an open portion and a closed portion, a holding element in the form of a clamp 640 is placed on the shell members to maintain the positioning of the shell members (i.e., to maintain the open portion and the closed portion) for subsequent filling operations.

Next, a filling nozzle 642 is moved into the cavity 610 of the muffler shell 602 through the open portion. As shown in FIG. 6, the filling nozzle 642 is positioned in the third chamber 638 of the cavity 610. The filling nozzle 642 introduces a predetermined quantity of the fibrous material along a filling axis into the third chamber 638 of the cavity 610.

Once the filling operation is completed, assembly of the muffler assembly 600 can be completed by, for example, removing the clamp 640 and affixing (e.g., welding, crimping) the shell members to one another.

Figure 7:
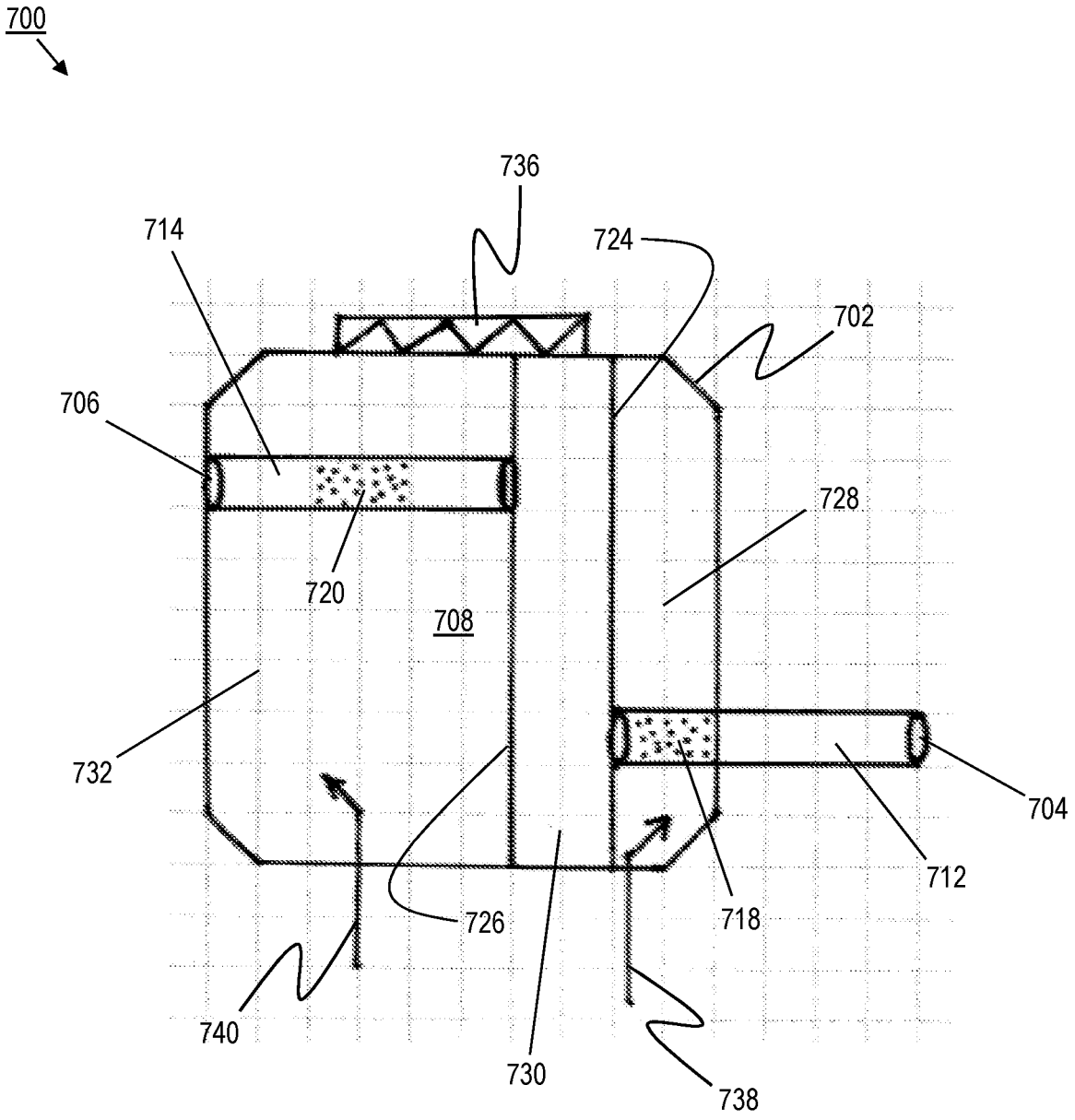
FIG. 7 is a cutaway diagram of a muffler assembly, according to an exemplary embodiment, for describing a filling operation.

In FIG. 7, a muffler assembly 700 includes a muffler shell 702. The muffler shell 702 is a housing, body, or the like that defines a cavity 708 therein. The muffler shell 702 comprises at least two housing members that are eventually joined to form the muffler assembly 700. For example, the muffler assembly 700 can be a two-piece clamshell muffler that comprises a first shell member (e.g., upper body) and a second shell member (e.g., lower body) that together form the muffler shell 702.

The muffler shell 702 includes an inlet port 704 and an outlet port 706. The inlet port 704 and the outlet port 706 are in communication with the cavity 708 of the muffler shell 702. In this manner, exhaust gases may enter the cavity 708 through the inlet port 704 and exit the cavity 708 through the outlet port 706.

The muffler assembly 700 includes an inlet pipe 712 and an outlet pipe 714. The inlet pipe 712 extends from or through the inlet port 704 and into the cavity 708. The outlet pipe 714 extends from or through the outlet port 706 and into the cavity 708. The pipes 712, 714 function to deliver gases into and out of the muffler assembly 700, respectively. A portion 718 of the inlet pipe 712 is perforated to allow the gases in the inlet pipe 712 to be exposed to the cavity 708. A portion 720 of the outlet pipe 714 is perforated to allow the gases in the outlet pipe 714 to be exposed to the cavity 708.

Because at least a portion of the cavity 708 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 708 via the pipes 712, 714.

The muffler shell 702 includes a first partition 724 and a second partition 726 that divide the cavity 708 into a first chamber 728, a second chamber 730, and a third chamber 732. In some embodiments, the volume of at least one of the chambers 728, 730, 732 is different from the volume of the other chambers.

Various aspects of an exemplary method of filling the muffler assembly 300 with the fibrous material will now be explained.

After the shell members are positioned relative to one another, as described herein, to form an open portion and a closed portion, a holding element in the form of a clamp 736 is placed on the shell members to maintain the positioning of the shell members (i.e., to maintain the open portion and the closed portion) for subsequent filling operations.

Next, a pair of filling nozzles are introduced into the cavity 708 of the muffler shell 702 through the open portion. As shown in FIG. 7, a first filling nozzle 738 and a second filling nozzle 740 are used to introduce the fibrous material into the cavity 708 of the muffler shell 702. In particular, the first filling nozzle 738 is positioned to introduce the fibrous material in the first chamber 728, while the second filling nozzle 740 is positioned to introduce the fibrous material into the third chamber 732. While the general inventive concepts encompass using a single filling nozzle that moves from one location to another to deliver a quantity of the fibrous material at each predetermined location, the use of multiple filling nozzles (e.g., filling nozzles 738, 740) operating simultaneously at different locations can decrease the time needed to effect the desired filling of the muffler assembly 700.

Once the filling operation is completed, assembly of the muffler assembly 700 can be completed by, for example, removing the clamp 736 and affixing (e.g., welding, crimping) the shell members to one another.

In some embodiments, the filling nozzles 738, 740 can each have a different filling axis. In some embodiments, each filling nozzle 738, 740 can introduce a fibrous material that differs (e.g., in type, quantity, etc.) from the fibrous material introduced by the other filling nozzle. Accordingly, the amount of the fibrous material (i.e., the fill quantity) introduced into the first chamber 728 and the third chamber 732 may be the same or may be different.

Figure 8:
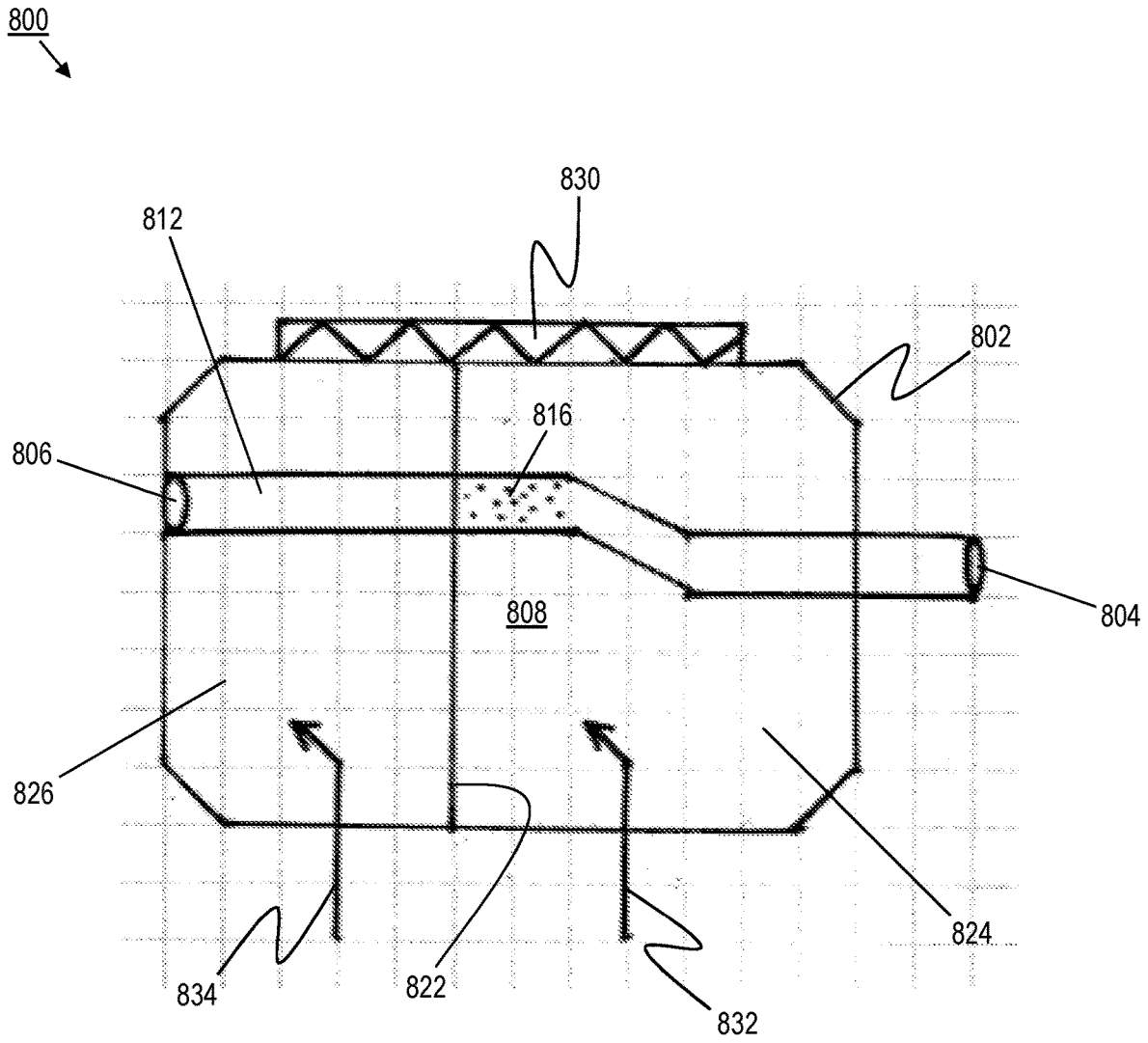
FIG. 8 is a cutaway diagram of a muffler assembly, according to an exemplary embodiment, for describing a filling operation.

In FIG. 8, a muffler assembly 800 includes a muffler shell 802. The muffler shell 802 is a housing, body, or the like that defines a cavity 808 therein. The muffler shell 802 comprises at least two housing members that are eventually joined to form the muffler assembly 800. For example, the muffler assembly 800 can be a two-piece clamshell muffler that comprises a first shell member (e.g., upper body) and a second shell member (e.g., lower body) that together form the muffler shell 802.

The muffler shell 802 includes an inlet port 804 and an outlet port 806. The inlet port 804 and the outlet port 806 are in communication with the cavity 808 of the muffler shell 802. In this manner, exhaust gases may enter the cavity 808 through the inlet port 804 and exit the cavity 808 through the outlet port 806.

The muffler assembly 800 includes a pipe 812 that extends from or through the inlet port 804, through the cavity 808, and to or through the outlet port 806. The pipe 812 functions to deliver gases into and out of the muffler assembly 800. A portion 816 of the pipe 812 is perforated to allow the gases in the pipe 812 to be exposed to the cavity 808.

Because at least a portion of the cavity 808 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 808 via the pipe 812.

The muffler shell 802 includes a partition 822 that divides the cavity 808 into a first chamber 824 and a second chamber 826. In some embodiments, the volume of the chambers 824, 826 is different. For example, the ratio of the volumes can be more than 1:1.5, more than 1:2, etc.

Various aspects of an exemplary method of filling the muffler assembly 800 with the fibrous material will now be explained.

After the shell members are positioned relative to one another, as described herein, to form an open portion and a closed portion, a holding element in the form of a clamp 830 is placed on the shell members to maintain the positioning of the shell members (i.e., to maintain the open portion and the closed portion) for subsequent filling operations.

Next, the filling nozzles are introduced into the cavity 808 of the muffler shell 802 through the open portion. As shown in FIG. 8, a pair of filling nozzles are used to introduce the fibrous material into the cavity 808 of the muffler shell 802. In particular, a first filling nozzle 832 and a second filling nozzle 834 are used. While the general inventive concepts encompass using a single filling nozzle that moves from one location to another to deliver a quantity of the fibrous material at each predetermined location, the use of multiple filling nozzles (e.g., filling nozzles 832, 834) operating simultaneously at different locations can decrease the time needed to effect the desired filling of the muffler assembly 800.

Once the filling operation is completed, assembly of the muffler assembly 800 can be completed by, for example, removing the clamp 830 and affixing (e.g., welding, crimping) the shell members to one another.

In FIG. 8, each chamber has a dedicated filling nozzle for introducing the fibrous material into that chamber. In particular, the first filling nozzle 832 is used to fill the first chamber 824, while the second filling nozzle 834 is used to fill the second chamber 826.

In some embodiments, the filling nozzles 832, 834 have different filling axes.

Figure 9:
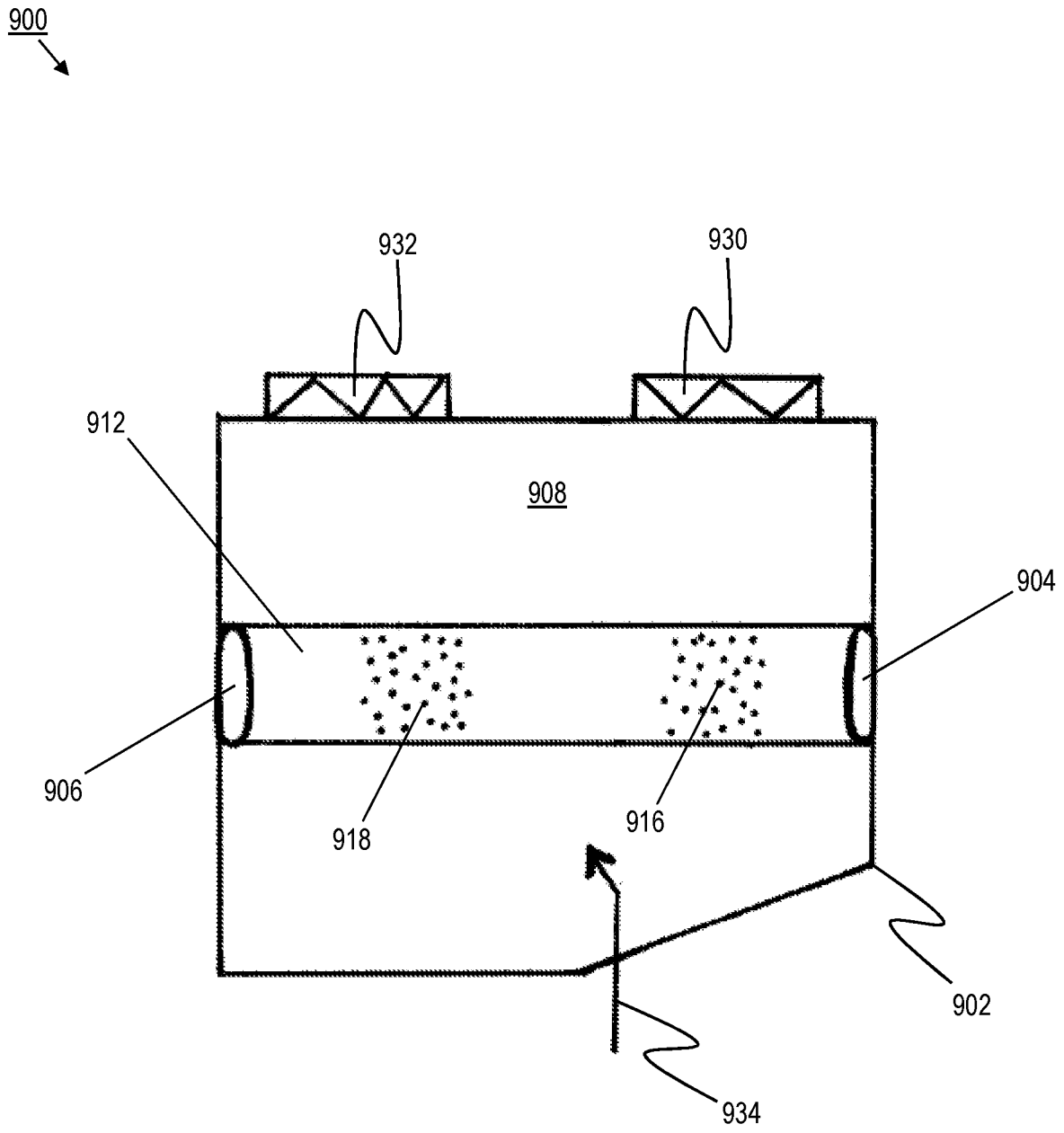
FIG. 9 is a cutaway diagram of a muffler assembly, according to an exemplary embodiment, for describing a filling operation.

In FIG. 9, a muffler assembly 900 includes a muffler shell 902. The muffler shell 902 is a housing, body, or the like that defines a cavity 908 therein. The muffler shell 902 comprises at least two housing members that are eventually joined to form the muffler assembly 900. For example, the muffler assembly 900 can be a two-piece clamshell muffler that comprises a first shell member (e.g., upper body) and a second shell member (e.g., lower body) that together form the muffler shell 902.

The muffler shell 902 includes an inlet port 904 and an outlet port 906. The inlet port 904 and the outlet port 906 are in communication with the cavity 908 of the muffler shell 902. In this manner, exhaust gases may enter the cavity 908 through the inlet port 904 and exit the cavity 908 through the outlet port 906.

The muffler assembly 900 includes a pipe 912 that extends from or through the inlet port 904, through the cavity 908, and to or through the outlet port 906. The pipe 912 functions to deliver gases into and out of the muffler assembly 900. A first portion 916 and a second portion 918 of the pipe 912 are perforated to allow the gases in the pipe 912 to be exposed to the cavity 908.

Because at least a portion of the cavity 908 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 908 via the pipe 912.

Various aspects of an exemplary method of filling the muffler assembly 900 with the fibrous material will now be explained.

After the shell members are positioned relative to one another, as described herein, to form an open portion and a closed portion, a holding element comprising a first clamp 930 and a second clamp 932 is placed on the shell members to maintain the positioning of the shell members (i.e., to maintain the open portion and the closed portion) for subsequent filling operations.

Next, a filling nozzle 934 is introduced into the cavity 908 of the muffler shell 902 through the open portion. The filling nozzle 934 introduces a predetermined quantity (i.e., the filling quantity) of the fibrous material along a filling axis into the cavity 908.

Once the filling operation is completed, assembly of the muffler assembly 900 can be completed by, for example, removing the clamps 930, 932 and affixing (e.g., welding, crimping) the shell members to one another.

Figure 10:
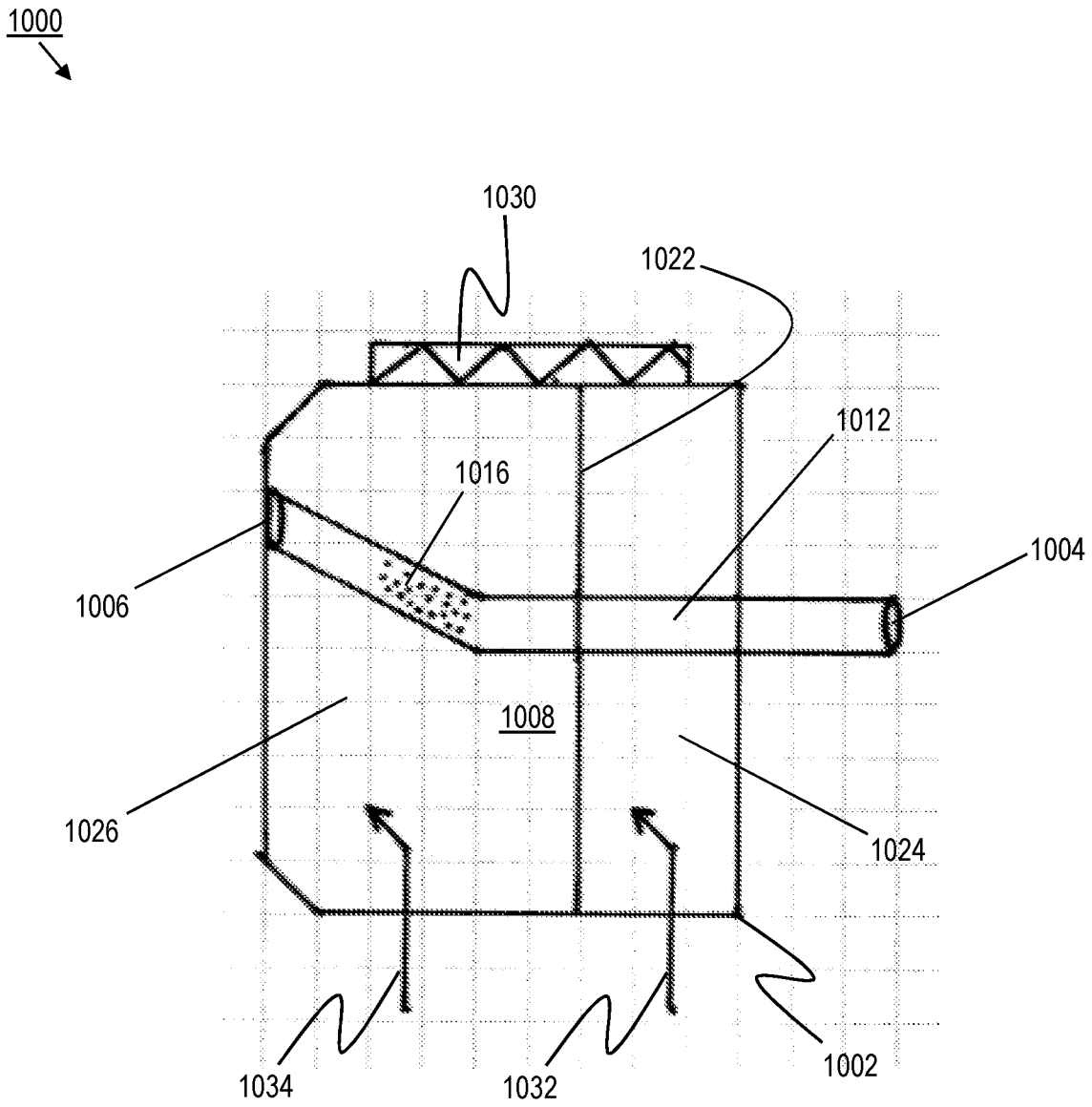
FIG. 10 is a cutaway diagram of a muffler assembly, according to an exemplary embodiment, for describing a filling operation.

In FIG. 10, a muffler assembly 1000 includes a muffler shell 1002. The muffler shell 1002 is a housing, body, or the like that defines a cavity 1008 therein. The muffler shell 1002 comprises at least two housing members that are eventually joined to form the muffler assembly 1000. For example, the muffler assembly 1000 can be a two-piece clamshell muffler that comprises a first shell member (e.g., upper body) and a second shell member (e.g., lower body) that together form the muffler shell 1002.

The muffler shell 1002 includes an inlet port 1004 and an outlet port 1006. The inlet port 1004 and the outlet port 1006 are in communication with the cavity 1008 of the muffler shell 1002. In this manner, exhaust gases may enter the cavity 1008 through the inlet port 1004 and exit the cavity 1008 through the outlet port 1006.

The muffler assembly 1000 includes a pipe 1012 that extends from or through the inlet port 1004, through the cavity 1008, and to or through the outlet port 1006. The pipe 1012 functions to deliver gases into and out of the muffler assembly 1000. A portion 1016 of the pipe 1012 is perforated to allow the gases in the pipe 1012 to be exposed to the cavity 1008.

Because at least a portion of the cavity 1008 is filled with a fibrous material (e.g., texturized fiberglass), sound that would otherwise be produced by the exhaust gases can be absorbed and attenuated by the fibrous material as the exhaust gases are exposed to the fibrous material while passing through the cavity 1008 via the pipe 1012.

The muffler shell 1002 includes a partition 1022 that divides the cavity 1008 into a first chamber 1024 and a second chamber 1026. In some embodiments, the volume of the chambers 1024, 1026 is different. For example, the ratio of the volumes can be more than 1:1.5, more than 1:2, etc.

Various aspects of an exemplary method of filling the muffler assembly 1000 with the fibrous material will now be explained.

After the shell members are positioned relative to one another, as described herein, to form an open portion and a closed portion, a holding element in the form of a clamp 1030 is placed on the shell members to maintain the positioning of the shell members (i.e., to maintain the open portion and the closed portion) for subsequent filling operations.

Next, the filling nozzles are introduced into the cavity 1008 of the muffler shell 1002 through the open portion. As shown in FIG. 10, a pair of filling nozzles are used to introduce the fibrous material into the cavity 1008 of the muffler shell 1002. In particular, a first filling nozzle 1032 and a second filling nozzle 1034 are used. While the general inventive concepts encompass using a single filling nozzle that moves from one location to another to deliver a quantity of the fibrous material at each predetermined location, the use of multiple filling nozzles (e.g., filling nozzles 1032, 1034) operating simultaneously at different locations can decrease the time needed to effect the desired filling of the muffler assembly 1000.

Once the filling operation is completed, assembly of the muffler assembly 1000 can be completed by, for example, removing the clamp 1030 and affixing (e.g., welding, crimping) the shell members to one another.

In FIG. 10, each chamber has a dedicated filling nozzle for introducing the fibrous material into that chamber. In particular, the first filling nozzle 1032 is used to fill the first chamber 1024, while the second filling nozzle 1034 is used to fill the second chamber 1026.

In some embodiments, the filling nozzles 1032, 1034 have different filling axes.

Figure 11:
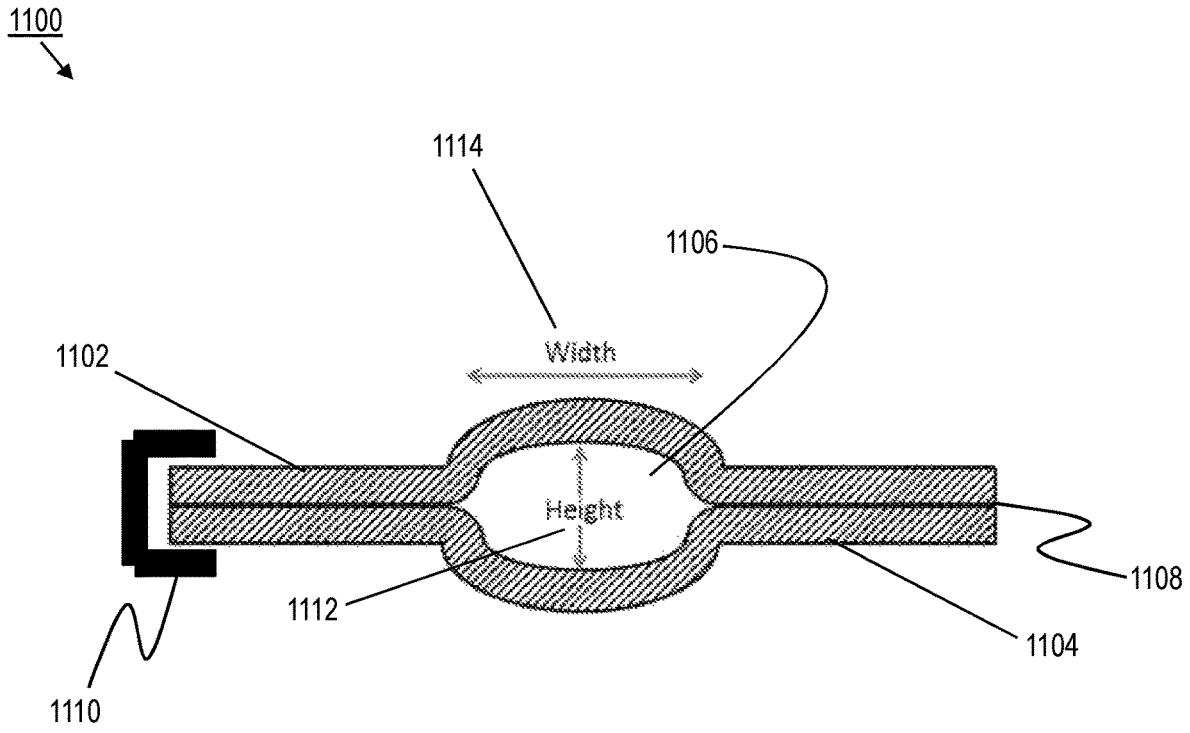
FIG. 11 is a cross-sectional view of an interface between shell members of a muffler assembly, according to an exemplary embodiment.

An exemplary alternative embodiment, encompassed by the general inventive concepts, is shown in FIG. 11. As shown in FIG. 11, a muffler assembly 1100 includes an interface between a first shell member 1102 and a second shell member 1104. In particular, the shell members 1102, 1104 are positioned relative to one another so as to define a pre-formed open portion 1106 and a closed portion 1108. In some embodiments, the shell members 1102, 1104 define a plurality of pre-formed open portions 1106 (e.g., around a periphery of the muffler assembly 1100). In general, the shell members 1102, 1104 are temporarily joined (e.g., by an elastic band) prior to introduction of the fibrous material into the muffler assembly 1100. In some embodiments, the shell members 1102, 1104 are temporarily joined by a clamp 1110. In this manner, the closed portion 1108 is maintained during the filling operation.

Each pre-formed open portion 1106 will typically have dimensions that closely adhere to the dimensions (e.g., outer circumference) of a filling nozzle intended to pass through the open portion 1106 and into a cavity of the muffler assembly 1100. For example, the open portion 1106 can have a height 1112 and a width 1114 that are only slightly larger than a corresponding height and width of the filling nozzle. In some embodiments, the height 1112 of the pre-formed open portion 1106 is within the range of 5 mm to 20 mm. In some embodiments, the width 1114 of the pre-formed open portion 1106 is within the range of 5 mm to 20 mm.

Although increasing the dimensions of the pre-formed open portion 1106 to greatly exceed that of the filling nozzle might make it easier to insert and remove the filling nozzle through the open portion 1106, it would also increase the likelihood of some of the fibrous material escaping through the open portion 1106 during the filling operation. Accordingly, the dimensions of the pre-formed open portion 1106 are generally kept as small as possible.

By inserting the filling nozzle into the muffler assembly 1100 through the pre-formed open portion 1106, the fibrous material can be introduced into the muffler assembly 1100, as described herein. For those embodiments where the muffler assembly 1100 includes multiple pre-formed open portions 1106, a single filling nozzle can be used at each different open portion 1106 over time, or multiple filling nozzles can be used at the open portions 1106 simultaneously. Once the muffler assembly 1100 has been filled with the fibrous material (i.e., in the amounts and at the locations desired for the particular muffler assembly 1100), the filling nozzle is removed from the muffler assembly 1100 through the open portion 1106.

Thereafter, the open portion 1106 is closed or otherwise sealed to complete the filling method. The open portion 1106 can be closed in any manner suitable for preventing further passage of material (e.g., the fibrous material) through the open portion 1106. In some embodiments, the open portion 1106 is deformed (e.g., crimped, folded), which causes the open portion 1106 to be closed. In some embodiments, the open portion 1106 receives a plug, which causes the open portion 1106 to be closed. In some embodiments, the open portion 1106 is capped or otherwise covered, which causes the open portion to be closed. The clamp 1110 or other temporary closing means can be removed before or after the closing operation. In some embodiments, the clamp 1110 or other temporary closing means is removed during the closing operation. In some embodiments, the clamp 1110 or other temporary closing means is left on and forms part of the completed muffler assembly 1110.

It will be appreciated that some aspects of the illustrated muffler assemblies are, in large measure, known in the art, and these aspects may be omitted for purposes of more readily illustrating various aspects of the general inventive concepts. Furthermore, the scope of the general inventive concepts are not intended to be limited to the particular exemplary embodiments shown and described herein. From the disclosure given, those skilled in the art will not only understand the general inventive concepts and their attendant advantages, but will also find apparent various changes and modifications to the methods and systems disclosed. It is sought, therefore, to cover all such changes and modifications as fall within the spirit and scope of the general inventive concepts, as described and claimed herein, and any equivalents thereof. For example, while the exemplary embodiments shown and described herein often reference a two-part, clamshell muffler design, the general inventive concepts are not so limited and instead are applicable to any muffler configuration in which at least two housing portions are mechanically joined to one another as part of the muffler assembly.

The invention claimed is:

1. A method of filling a muffler with a fibrous material, the muffler including a muffler shell having an inlet port and an outlet port, wherein the muffler shell comprises a first shell member and a second shell member, the method comprising:

using a clamp to affix the first shell member and the second shell member to one another to define an open portion and a closed portion, the open portion defining a portion of the circumference of the muffler shell wherein the shell members are so spaced as to allow a filling nozzle to fit between the first shell member and the second shell member at the open portion;

inserting the filling nozzle into the muffler shell through the open portion;

introducing the fibrous material into the muffler shell through the filling nozzle;

removing the filling nozzle from the muffler shell through the open portion: and removing the clamp to close the open portion.

2. The method of claim 1, wherein inserting the filling nozzle into the muffler shell through the open portion further comprises:

inserting a first filling nozzle into the muffler shell at a first location through the open portion; and inserting a second filling nozzle into the muffler shell at a second location through the open portion.

3. The method of claim 2, wherein the muffler includes a partition forming a first chamber and a second chamber within the muffler shell, wherein an outlet opening of the first filling nozzle is positioned within the first chamber, and wherein an outlet opening of the second filling nozzle is positioned within the second chamber.

4. The method of claim 2, wherein the fibrous material is introduced into the muffler shell through the first filling nozzle and the second filling nozzle simultaneously.

5. The method of claim 1, further comprising evacuating air from within the muffler shell during the introduction of the fibrous material into the muffler shell.

6. The method of claim 5, wherein the air is evacuated from within the muffler shell through at least one of the inlet port and the outlet port.

7. The method of claim 1, wherein the filling nozzle includes an outlet opening that is shaped to direct the fibrous material along a filling axis, and wherein the filling axis is not parallel to a central axis of the filling nozzle.

8. The method of claim 7, wherein the filling axis forms an angle relative to the central axis of the filling nozzle within a range of 0 degrees to 90 degrees.

9. The method of claim 7, wherein the filling axis forms an angle relative to the central axis of the filling nozzle within a range of 10 degrees to 55 degrees.

10. The method of claim 7, further comprising positioning the outlet opening at a desired filling location within the muffler shell prior to introducing the fibrous material into the muffler shell.

11. The method of claim 10, wherein inserting the filling nozzle into the muffler shell through the open portion and introducing the fibrous material into the muffler shell through the filling nozzle further comprises:

positioning the outlet opening at a first filling location within the muffler shell and introducing a first quantity of the fibrous material into the muffler shell; and positioning the outlet opening at a second filling location within the muffler shell and introducing a second quantity of the fibrous material into the muffler shell.

12. The method of claim 11, wherein the first quantity and the second quantity are the same.

13. The method of claim 7, further comprising rotating the filling nozzle such that the outlet opening is pointed in a desired filling direction prior to introducing the fibrous material into the muffler shell.

14. The method of claim 1, further comprising repositioning the filling nozzle during the introduction of the fibrous material into the muffler shell.

15. The method of claim 1, further comprising rotating the filling nozzle during the introduction of the fibrous material into the muffler shell.

16. The method of claim 1, wherein a pipe extends between the inlet port and the outlet port, and wherein at least a portion of the pipe within the muffler shell is perforated.

17. The method of claim 1, wherein the muffler includes a partition forming a first chamber and a second chamber within the muffler shell.

18. The method of claim 17, wherein at least a portion of the partition is perforated.

19. The method of claim 17, wherein the inlet port interfaces with the first chamber and the outlet port interfaces with the second chamber.

20. The method of claim 19, wherein a first pipe is interfaced with the inlet port and is open to the first chamber, and wherein a second pipe is interfaced with the outlet port and is open to the second chamber.

21. The method of claim 20, wherein at least a portion of the first pipe within the muffler shell is perforated.

22. The method of claim 20, wherein at least a portion of the second pipe within the muffler shell is perforated.

23. The method of claim 1, wherein a height of the opening is within a range of 5 mm to 20 mm.

24. The method of claim 1, wherein the fibrous material is fiberglass.

25. The method of claim 24, wherein the fiberglass is texturized.

26. The method of claim 24, wherein the fiberglass comprises one of E-glass filaments and S-glass filaments.

* * * * *